US011993897B2

(12) United States Patent
Lura

(10) Patent No.: US 11,993,897 B2
(45) **Date of Patent: *May 28, 2024**

(54) CURB FORMER

(71) Applicant: Lura Enterprises, Inc., Fargo, ND (US)

(72) Inventor: Dennis K. Lura, Fargo, ND (US)

(73) Assignee: Lura Enterprises, Inc., Fargo, ND (US)

( * ) Notice: Subject to any disclaimer, the term of this patent is extended or adjusted under 35 U.S.C. 154(b) by 217 days.

This patent is subject to a terminal disclaimer.

(21) Appl. No.: 17/405,176

(22) Filed: Aug. 18, 2021

(65) Prior Publication Data

US 2021/0381176 A1 Dec. 9, 2021

Related U.S. Application Data

(62) Division of application No. 16/228,411, filed on Dec. 20, 2018, now Pat. No. 11,111,637.

(60) Provisional application No. 62/619,369, filed on Jan. 19, 2018, provisional application No. 62/614,139, filed on Jan. 5, 2018.

(51) Int. Cl.

| | |
|---|---|
| ***E01C 19/23*** | (2006.01) |
| ***E01C 19/24*** | (2006.01) |
| ***E01C 19/50*** | (2006.01) |

(52) U.S. Cl.

CPC ..... *E01C 19/236* (2013.01); *E01C 19/24* (2013.01); *E01C 19/506* (2013.01)

(58) Field of Classification Search

None

See application file for complete search history.

(56) References Cited

U.S. PATENT DOCUMENTS

| | | | |
|---|---|---|---|
| 827,587 | A | 7/1906 | Warner |
| 1,018,780 | A | 2/1912 | Rauschenbach |
| 1,279,059 | A | 9/1918 | Whiteway et al. |
| 1,334,483 | A | 3/1920 | Brooks et al. |
| 1,548,452 | A | 8/1925 | Fyhrie |
| 1,831,116 | A | 11/1931 | Huntley |
| 2,764,798 | A | 10/1956 | Huff |
| 2,831,408 | A | 4/1958 | Konway |
| 2,894,310 | A | 7/1959 | Hogan et al. |
| 2,925,759 | A | 2/1960 | Hillis |
| 3,223,006 | A | 12/1965 | Jones et al. |

(Continued)

FOREIGN PATENT DOCUMENTS

| | | | |
|---|---|---|---|
| EP | 2886716 | A1 | 6/2015 |
| GB | 366426 | A | 2/1932 |

(Continued)

*Primary Examiner* — Thomas B Will
*Assistant Examiner* — Katherine J Chu
(74) *Attorney, Agent, or Firm* — Snell & Wilmer L.L.P.

(57) ABSTRACT

A curb former (10) includes a rotatable drive shaft (20), a gutter drum (80), and a curb profiling drum (100). The gutter drum (80) is secured to the drive shaft (20) such that the drive shaft (20) and gutter drum (80) rotate together. The curb profiling drum (100) is detachably secured relative to both the drive shaft (20) and the gutter drum (80). This configuration allows one curb profiling drum (100) to be replaced with another curb profiling drum (100) to change the profile of a curb resulting from a curbing operation using the curb former (10).

21 Claims, 17 Drawing Sheets

(56) References Cited

U.S. PATENT DOCUMENTS

| | | | | | |
|---|---|---|---|---|---|
| 3,224,348 | A | * | 12/1965 | Maginniss | E04G 21/066 404/114 |
| 4,097,173 | A | | 6/1978 | Tout | |
| 4,397,626 | A | * | 8/1983 | Morrison | E01C 19/40 425/456 |
| 4,702,640 | A | | 10/1987 | Allen | |
| 5,527,129 | A | | 6/1996 | McKinnon | |
| 6,503,558 | B2 | | 1/2003 | Williamson | |
| 7,544,012 | B2 | | 6/2009 | Lura | |
| 7,621,694 | B1 | | 11/2009 | Goodman et al. | |
| 8,240,949 | B2 | | 8/2012 | Weber | |
| 8,297,878 | B2 | | 10/2012 | Goodman et al. | |
| 11,111,637 | B2 | * | 9/2021 | Lura | E01C 19/506 |
| 2003/0113165 | A1 | | 6/2003 | Eggleton et al. | |
| 2007/0134064 | A1 | | 6/2007 | Lura | |
| 2010/0021235 | A1 | | 1/2010 | Goodman et al. | |
| 2011/0188930 | A1 | | 8/2011 | Lura | |
| 2020/0087871 | A1 | | 3/2020 | Terstriep | |

FOREIGN PATENT DOCUMENTS

| | | | |
|---|---|---|---|
| JP | 61-5112 | A | 1/1986 |
| WO | 2009146702 | A1 | 12/2009 |

* cited by examiner

CURB FORMER

CROSS-REFERENCE TO RELATED APPLICATIONS

This patent application is a divisional application of co-pending U.S. patent application Ser. No. 16/228,411, filed Dec. 20, 2018, which claims the benefit of U.S. Provisional Patent Application No. 62/614,139, filed Jan. 5, 2018, and further claims the benefit of U.S. Provisional Patent Application No. 62/619,369, filed Jan. 19, 2018. The entire disclosure of each patent application set forth in the Cross-Reference to Related Applications section is hereby incorporated by reference.

FIELD OF THE INVENTION

The present invention generally relates to curbs and, more particularly, to devices that form curbs.

BACKGROUND

Concrete may be poured between a pair of forms, between a pair of existing, hardened concrete slabs, between a form and an existing, hardened concrete slab, or the like. Such a configuration may be used to form slabs, curbs, and the like. In any case and once the concrete is poured, it may be leveled and compacted by a process known as "screeding." Various types of screeding devices have been used over time.

A basic screeding device may be a simple 2×4 or some other elongate member. One or more workers would place the 2×4 on the forms and pull/slide the 2×4 along the forms to screed the poured concrete. While this manual technique may work to at least some degree for at least smaller jobs (e.g., short sections of sidewalk), there are a number of deficiencies. One of course is that this technique is very labor intensive and physically demanding. This type of screeding is also not very effective at distributing and compacting the concrete within the forms, thereby potentially producing a finished concrete slab of a lesser quality than may be desired.

Truss screeds also exist, and tend to be used for larger jobs. The concrete is leveled off with an elongated truss. One or more internal combustion engines or the like may be mounted on the truss to vibrate the truss to enhance the screeding. Typically one or more winches are incorporated into the truss to advance the same along the forms. Both manual and motorized winches exist for truss screeds.

Another type of powered screed is a powered roller screed. The powered roller screed generally consists of a screed roller (e.g., an elongated tube) that is rotationally driven by an attached motor or other drive source. In operation, the screed roller is positioned over the poured concrete with each end of the screed roller positioned on the upper edges of the laterally-spaced forms. The screed roller is then moved along the top of the forms in a direction that is opposite to the rotational motion of the screed roller at its point of contact with the concrete. Usually one worker pulls on one end of the powered roller screed, and another worker pulls on the opposite end of the powered roller screed. Powered roller screeds produce a smooth and flat finish to the concrete.

SUMMARY

A first aspect of the present invention is directed to a curb former that includes a drive shaft, a drum, and a first curb profiling drum. The first curb profiling drum is detachably mounted relative to both the drive shaft and the drum. Adjacent end portions of the drum and first curb profiling drum may be disposed at least generally in proximity to one another (e.g., corresponding end portions of the drum and first curb profiling drum may be engaged with one another; corresponding end portions of the drum and first curb profiling drum may be disposed in abutting or interfacing relation; corresponding end portions of the drum and first curb profiling drum may be disposed in closely spaced relation).

A number of feature refinements and additional features are applicable to the first aspect of the present invention. These feature refinements and additional features may be used individually or in any combination. The following discussion is applicable to at least the first aspect of the present invention.

The drive shaft may be characterized as having a length or length dimension that coincides with its rotational axis. References herein to "being spaced along the drive shaft" thereby may be equated with being spaced along the length dimension/rotational axis of the drive shaft. One embodiment has the drive shaft being in the form of a screed roller. The screed roller may be of any appropriate size (e.g., length), shape (e.g., a cylindrical perimeter), and/or configuration. Each of the two opposite ends of the screed roller may be configured for engagement by a drive assembly. The screed roller could include a single cylindrical tube of a desired length. The screed roller could also be defined by detachably interconnecting two or more separate, cylindrical screed roller sections in end-to-end relation (e.g., via a threaded connection between each adjacent pair of screed roller sections; each screed roller section may have a threaded male member on one end and a threaded female member on its opposite end). Any appropriate number of detachably interconnected screed roller sections may be utilized to define a screed roller of a desired/required length. "Detachably interconnected" means that individual screed roller sections may be repeatedly joined and separated, or vice versa, as desired/required. Each separate screed roller section used by the screed roller may be of any appropriate length. Two or more of multiple screed roller sections that define the screed roller may be of different lengths, although such may not be the case in all instances. The overall length of the screed roller may be varied by removing and/or adding at least one screed roller section.

Perimeter surfaces of the drum and the first curb profiling drum may be concentrically disposed relative to the rotational axis of the drive shaft. A perimeter surface of the drum may be cylindrical, while at least part of a perimeter surface of the first curb profiling drum may be of a non-cylindrical configuration. An outer diameter of the drum may be larger than the outer diameter of at least part of the first curb profiling drum. In one embodiment, at least part of the perimeter surface of the first curb profiling drum at least generally converges toward the drive shaft in proceeding in a direction that is away from the drum. In one embodiment, the outer diameter of at least part of the first curb profiling drum (e.g., an end of the first curb profiling drum that is opposite that which is disposed closest to the drum) is at least 3 inches less than an outer diameter of the drum.

The drum may be mounted to the drive shaft in any appropriate manner, preferably such that the drive shaft and drum collectively rotate together. Rotation of the drive shaft in a first direction and at a first rotational speed should thereby simultaneously rotate the drum in the same first direction and at the same first rotational speed. As a corresponding portion of the drum may form a gutter for a curb, the drum may be referred to as a "gutter drum." In any case, one embodiment has the drum being fixedly attached to the drive shaft in any appropriate manner (e.g., welding; a non-detachable/removable interconnection).

Detachably integrating the first curb profiling drum accommodates using the same drive shaft and drum to produce various different curb profiles simply by changing out one curb profiling drum of one curb profile for another curb profiling drum of a different curb profile. The first curb profiling drum may be of a first curb profile, while a replacement first curb profiling drum may be of a second curb profile that differs in at least one respect from the first curb profile. The detachable integration of the first curb profiling drum allows the first curb profiling drum to be disconnected and removed from the curb former for substitution by a replacement first curb profiling drum (where this replacement first curb profiling drum would then be detachably interconnected in the same manner as the original first curb profiling drum). Stated another way, one first curb profiling drum having one curb profile may be used by the curb former, and thereafter may be removed from the curb former and replaced by another first curb profiling drum having a different curb profile, all by the detachable integration used in relation to the first curb profiling drum for purposes of the first aspect.

Any appropriate way of detachably interconnecting the first curb profiling drum relative to both the drive shaft and drum may be utilized. One option is to use a plurality of fasteners to detachably secure the first curb profiling drum to the drum, and to separately secure the drum to the drive shaft (e.g., in the above-noted manner). Threaded fasteners in the forms of screws, bolts, or the like may be used to detachably mount the first curb profiling drum to the drum. Any appropriate number of threaded fasteners may be used to detachably mount the first curb profiling drum to the drum. In any case, the detachable integration of the first curb profiling drum with the curb former is such that the drive shaft, drum, and first curb profiling drum collectively rotate together. Rotation of the drive shaft in a first direction and at a first rotational speed should thereby simultaneously rotate both the drum and first curb profiling drum in the same first direction and at the same first rotational speed.

What may be characterized as a curbing system may include the curb former, along with a pair of forms that are disposed in spaced relation to one another and with there being wet concrete between the pair of forms. These forms may support the curb former at two locations that are spaced in a lateral dimension (the lateral dimension coinciding with the spacing between the forms). Rotation of the drive shaft, drum, and first curb profiling drum in a common rotational direction and at a common rotational speed, as the curb former is advanced along the forms in a longitudinal dimension (the longitudinal dimension coinciding with the length of the forms, and typically where the drive shaft, drum, and first curb profiling drum are being rotated in a direction that opposes the direction that the curb former is advanced along the length dimension of the forms), screeds the wet concrete and forms at least a curb. The curb former may be used to simultaneously form a curb and an integral gutter (e.g., where there is no joint of any kind between the curb and gutter). At least a portion of the length of the drum may define the gutter portion of the integral curb and gutter, while the first curb profiling drum may define the curb portion of the integral curb and gutter. Typically the forms will be spaced no more than about 36" apart when defining an integral curb and gutter configuration.

The curb former may include a guide that is detachably mounted on the drive shaft (e.g., such that the drive shaft and guide collectively rotate together in a common rotational direction). Such a guide may be incorporated so that the first curb profiling drum is located between the drum and the guide proceeding along the drive shaft when using the first curb profiling drum for a curbing operation. Any appropriate way of detachably mounting the guide to the drive shaft may be utilized, such as by clamping the guide onto the drive shaft. In this regard, the guide may include a pair of split clamp rings that are spaced from one another along the drive shaft and that each clamp the guide to the drive shaft (albeit at two different locations that are spaced along the drive shaft).

The guide may be disposed in a variety of different positions along the length of the drive shaft, and may be disposed in a fixed position relative to the drive shaft in each of these different positions. Generally, changing the position of the guide relative to the first curb profiling drum along the drive shaft will change the width of the upper wall of a curb when using the first curb profiling drum for a curbing operation. One embodiment has the guide including a sleeve, a first guide flange that extends radially outwardly from/relative to the sleeve, and a second guide flange that is spaced from the first guide flange along the drive shaft and that also extends radially outwardly from/relative to the sleeve, with the first guide flange being located between the second guide flange and the first curb profiling drum along/relative to the drive shaft when the first curb profiling drum is being used for a curbing operation. Both the first guide flange and second guide flange may be in the form of planar or plate-like structures that are oriented orthogonal/perpendicular to the rotational axis of the drive shaft, including where the first and second guide flanges each have a circular perimeter, have a common outer diameter, or both.

A curbing system may include the curb former and the noted guide, along with a lower form and an upper form. The upper form is spaced from the lower form (e.g., in the lateral dimension) and extends to a higher elevation than the lower form. The upper form includes an inboard surface and an outboard surface, where the inboard surface of the upper form projects in a direction that the lower form is spaced from the upper form (e.g., in the lateral dimension). Wet concrete exists between the lower form and the upper form. The above-noted configuration for the guide provides two different options for guiding the curb former for such a curbing system. A first guiding option is for the drum to be positioned on an upper surface of the lower form, for one of the first curb profiling drum and the drive shaft to be positioned on an upper surface of the upper form, and for the first guide flange to be engagement with the outboard surface of the upper form (e.g., the outboard surface of the upper form facing or projecting in an opposite direction compared to the inboard surface of the upper form; the outboard surface of the upper form facing or projecting away from the lower form). A second guiding option is for the drum to be positioned on an upper surface of the lower form, for the sleeve of the guide to be positioned on an upper surface of the upper form, and for an upper section of the upper form to be positioned between the first and second guide flanges. In both instances, the guide is used to control the position of the curb former relative to the lower and upper forms, in the dimension that the upper and lower forms are spaced from one another (the noted lateral dimension) as the curb former is advanced along the length dimension of the upper and lower forms.

The drum of the curb former may be characterized as including first and second drum ends that are spaced from one another along the drive shaft. The drive shaft and drum may be integrated such that a first drive shaft section (of the drive shaft) extends beyond the first drum end and in a direction that is away from the second drum end, and such that a second drive shaft section (of the drive shaft) extends beyond the second drum end in a direction that is away from the first drum end. Another characterization is that the drum is disposed between the first and second drive shaft sections (e.g., with an intermediate portion of the drive shaft extending through the drum and interconnecting the noted first and second drive shaft sections).

Each of the first drive shaft section and the second drive shaft section may be of any appropriate length (e.g., at least about 2 feet), for instance so as to accommodate installation of both the first curb profiling drum and the above-noted guide thereon. When the first curbing profiling drum is being used for a curbing operation by the curb former, both the first curb profiling drum and guide will be positioned on a common one of the first drive shaft section and the second drive shaft section. Either the first curb profiling drum and guide will be positioned on the first drive shaft section when the first curbing profiling drum is being used for a curbing operation, or the first curb profiling drum and guide will be positioned on the second drive shaft section when the first curbing profiling drum is being used for a curbing operation.

The noted first drive shaft section may include a first drive input, while the second drive shaft section may include a second drive input. One embodiment has the first drive input being on a first free end of the first drive shaft section, and the second drive input being on a second free end of the second drive shaft section. In any case, the same drive assembly may be incorporated by the curb former in either of a first drive configuration or a second drive configuration. The first drive configuration entails the drive assembly interfacing with the first drive input of the first drive shaft section (whether the first curb profiling drum is on the first drive shaft section or the second drive shaft section), while the second drive configuration entails the drive assembly interfacing with the second drive input of the second drive shaft section (whether the first curb profiling drum is on the first drive shaft section or the second drive shaft section). If the first curb profiling drum is being used for a curbing operation, it would be typical interconnect the drive assembly with the same drive shaft section on which the first curb profiling drum is installed.

The drive assembly may include/utilize a power source, may be interconnected with the drive shaft in any appropriate manner, and may be operable to rotationally drive the drive shaft. Any appropriate power source may be utilized by the drive assembly. For instance, the drive assembly may utilize one or more motors of any appropriate type. Representative motors that may be used to simultaneously rotate the drive shaft, drum, and first curb profiling drum include without limitation an electric motor, an internal combustion engine (e.g., a gas engine), and the like. In one embodiment, the drive shaft, drum, and first curb profiling drum are simultaneously rotated at a relatively high velocity (e.g., at least about 100 RPM, including in a range from about 200 RPM to about 300 RPM, and including in a range from about 250 RPM to about 300 RPM) and in a direction that attempts to advance the drum and first curb profiling drum in the opposite direction that the curb former is normally pulled during a screeding operation to form at least a curb. In this regard, the drive assembly may incorporate a handle or handle assembly to accommodate pulling the curb former for a curbing operation in accordance with the foregoing.

The curb former may incorporate a second curb profiling drum. Perimeter surfaces of the drum and the second curb profiling drum may be concentrically disposed relative to the rotational axis of the drive shaft. A perimeter surface of the drum may be cylindrical as noted, while at least part of a perimeter surface of the second curb profiling drum may be of a non-cylindrical configuration. An outer diameter of the drum may be larger than the outer diameter of at least part of the second curb profiling drum. In one embodiment, at least part of the perimeter surface of the second curb profiling drum at least generally converges toward the drive shaft in proceeding in a direction that is away from the drum. In one embodiment, the outer diameter of at least part of the second curb profiling drum (e.g., an end of the second curb profiling drum that is opposite that which is disposed closest to the drum) is at least 3 inches less than an outer diameter of the drum.

The first curb profiling drum may be detachably mounted on the noted first drive shaft section. The second curb profiling drum may be mounted (e.g., detachably and including in the same manner as the first curb profiling drum) on the noted second drive shaft section. The profile of the first curb profiling drum may be different than the profile used by the second curb profiling drum. As such, the first curb profiling drum may be used to define a first curb profile through a first curbing operation by the curb former (e.g., by interconnecting the noted drive assembly with the first drive shaft section and pulling the curb former in accordance with the foregoing), while the second curb profiling drum may be used to define a second curb profile through a second curbing operation by the curb former (e.g., by interconnecting the noted drive assembly with the second drive shaft section and pulling the curb former in accordance with the foregoing), and including using the above-noted forms. The noted guide may be installed for use in conjunction with the first curb profiling drum (where the first curb profiling drum would then be located between the guide and the drum proceeding along the drive shaft of the curb former). The noted guide may also be installed for use in conjunction with the second curb profiling drum (where the second curb profiling drum would be located between the guide and the drum proceeding along the drive shaft of the curb former).

A second aspect of the present invention is directed to a curb former that includes a drive shaft, a drum, a first curb profiling drum, and a second curb profiling drum. The drum is mounted on the drive shaft and includes first and second drum ends that are spaced from one another along the drive shaft. A first drive shaft section extends beyond the first drum end and in a direction that is away from the second drum end. A second drive shaft section extends beyond the second drum end and in a direction that is away from the first drum end. The first curb profiling drum is positioned on the first drive shaft section in proximity to the first drum end (e.g., corresponding end portions of the drum and first curb profiling drum may be engaged with one another; corresponding end portions of the drum and first curb profiling drum may be disposed in abutting or interfacing relation; corresponding end portions of the drum and first curb profiling drum may be disposed in closely spaced relation). The second curb profiling drum is positioned on the second drive shaft section in proximity to the second drum end (e.g., corresponding end portions of the drum and second curb profiling drum may be engaged with one another; corresponding end portions of the drum and second curb profiling drum may be disposed in abutting or interfacing relation;

corresponding end portions of the drum and second curb profiling drum may be disposed in closely spaced relation).

A number of feature refinements and additional features are applicable to the second aspect of the present invention. These feature refinements and additional features may be used individually or in any combination. The following discussion is applicable to at least the second aspect of the present invention.

The drive shaft and drum of the second aspect curb former may be in accordance with the drive shaft and drum, respectively, discussed above in relation to the first aspect. At least one of the first and second curb profiling drums may be detachably integrated by the second aspect curb former in accordance with the first curb profiling drum of the first aspect (including having both of the first and second curb profiling drums being detachably integrated). A guide in accordance with the first aspect may be used by the second aspect curb former as well.

Regardless of the manner of integrating the drum, first curb profiling drum, and second curb profiling drum with the drive shaft (but preferably the integration collectively rotates the drive shaft, drum, first curb profiling drum, and second curb profiling drum in a common rotational direction and at a common rotational speed), the curb former may use the first curb profiling drum in a first curbing operation to define a first curb profile, and the curb former may use the second curb profiling drum in a second curbing operation to define a second curb profile (e.g., a profiling surface of the first curb profiling drum may differ in at least one respect from a profiling surface of the second curb profiling drum). The drive assembly discussed above in relation to the first aspect may be interconnected with the first drive shaft section when the first curbing profiling drum is used for a curbing operation (although the drive assembly could instead be interconnected with the second drive shaft section), while the drive assembly discussed above in relation to the first aspect may be interconnected with the second drive shaft section when the second curbing profiling drum is used for a curbing operation (although the drive assembly could instead be interconnected with the first drive shaft section). A drum assembly may be characterized as including the drum, first curb profiling drum, and the second curb profiling drum, with the drum being located between the first curb profiling drum and the second curb profiling drum along the drive shaft. The second aspect may then be viewed as using one end portion of the drum assembly to define a first curb profile in one curbing operation, and using the opposite end portion of the drum assembly to define a second curb profile in a different curbing operation.

A third aspect of the present invention may be characterized as a cement screeding system or a rotary screed having a drive shaft and a drum assembly. The drum assembly is mounted on the drive shaft and includes first and second drum ends that are spaced along the drive shaft by a distance of at least 5 feet. The drum assembly further includes a first curb forming section and a lane forming section. The first curb forming section includes a first curb profiling surface, while the lane forming section extends from the first curb forming section toward the second drum end and has a cylindrical perimeter.

A number of feature refinements and additional features are applicable to the third aspect of the present invention. These feature refinements and additional features may be used individually or in any combination. The following discussion is applicable to at least the third aspect. The drive shaft for the rotary screed may be in accordance with the drive shaft of first aspect, including all features related thereto (e.g., in the form of a screed roller; having first and second drive shaft sections; having first and second drive configurations and a corresponding drive assembly).

One embodiment has the drum assembly including a drum and a separate first curb profiling drum, with the drum defining the lane forming section and with the first curb profiling drum defining the first curb forming section. The drum for the rotary screed may be in accordance with the drum of the first aspect. The first curb profiling drum for the rotary screed may be in accordance with the first curb profiling drum of the first aspect, although the position of the first curb profiling drum alternatively could be fixed relative to both the drive shaft and the drum for purposes of this third aspect. The drum assembly may be of any appropriate configuration. A guide in accordance with the guide of the first aspect may be used by the rotary screed of this third aspect.

The rotary screed may be used to form a lane (e.g., via at least part of the lane profiling surface of the drum assembly) and at least one integral curb (e.g., via the first curb profiling surface). Representative lanes include a single lane of a road, street, highway, driveway, cart path, path, or the like. Such a lane may be at least 5 feet wide in one embodiment. In this regard, a pair of handles may be interconnected with the drive shaft to allow a pulling force to be exerted on the drive shaft at each of a pair of locations that are spaced from one another along the length of the drive shaft. Each handle may be rotationally isolated from the drive shaft (i.e., such that the handle(s) does not rotate along with the rotating drive shaft). At least one of these handles may be associated with a drive assembly that rotates the drive shaft. In one embodiment, a pair of drive assemblies are used to rotate the drive shaft. One handle/drive assembly may be associated with one end portion of the drive shaft, while another handle/drive assembly may be associate with an opposite end portion of the drive shaft.

The rotary screed may be used to form a lane (e.g., via at least part of the lane profiling surface of the drum assembly) and a pair of integral curbs. In this regard, the drum assembly may further include a second curb forming section that is spaced from the first curb forming section and that has a second curb profiling surface, with the lane forming section extending between the first curb forming section and the second curb forming section. The second curb profiling drum for the rotary screed may be in accordance with the second curb profiling drum of the first aspect, although the position of the second curb profiling drum alternatively could be fixed relative to both the drive shaft for purposes of this third aspect.

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a curb former includes "a first curb profiling drum" alone does not mean that the curb former includes only a single curb profiling drum). Moreover, any failure to use phrases such as "at least one" also does not limit the corresponding feature to the singular (e.g., indicating that a curb former includes "a curb profiling drum" alone does not mean that the curb former includes only a single curb profiling drum). Use of the phrase "at least generally" or the like in relation to a particular feature encompasses the corresponding characteristic and insubstantial variations thereof (e.g., indicating that a drum is at least generally cylindrical encompasses the drum actually being cylindrical). Finally, a reference of a feature in conjunction with the phrase "in one embodiment" does not limit the use of the feature to a single embodiment.

Various aspects of the present invention are also addressed by the following paragraphs and in the noted combinations:

1. A curb former, comprising:

a drive shaft;

a drum mounted on said drive shaft; and a first curb profiling drum detachably mounted relative to each of said drive shaft and said drum, wherein adjacent end portions of said drum and said first curb profiling drum are disposed in at least one of closely spaced or abutting relation.

2. The curb former of Paragraph 1, wherein said drive shaft comprises a screed roller.
3. The curb former of any of Paragraphs 1-2, wherein said drum is fixedly attached to said drive shaft.
4. The curb former of any of Paragraphs 1-3, wherein said drum is welded to said drive shaft.
5. The curb former of any of Paragraphs 1-4, wherein said drum is a gutter drum.
6. The curb former of any of Paragraphs 1-5, further comprising a plurality of fasteners that secure said first curb profiling drum to said drum.
7. The curb former of any of Paragraphs 1-6, further comprising a guide detachably mounted on said drive shaft, wherein said first curb profiling drum is located between said drum and said guide along said drive shaft.
8. The curb former of Paragraph 7, wherein said guide clamps onto said drive shaft.
9. The curb former of any of Paragraphs 7-8, wherein said guide comprises first and second split clamp rings that are spaced from one another along said drive shaft.
10. The curb former of any of Paragraphs 7-9, wherein said guide is disposable at each of a plurality of different positions along said drive shaft to accommodate different spacings between said first curb profiling drum and said guide along said drive shaft, and wherein said guide is securable to said drive shaft at each of said plurality of different positions.
11. The curb former of any of Paragraphs 7-10, wherein said guide comprises a sleeve, a first guide flange that extends radially outwardly relative to said sleeve, and a second guide flange that is spaced from said first guide flange and that also extends radially outwardly relative to said sleeve, and wherein said first guide flange is located between said second guide flange and said first curb profiling drum.
12. A curbing system comprising:

the curb former of Paragraph 11;

a lower form;

an upper form spaced from said lower form, that extends to a higher elevation than said lower form, and that comprises inboard and outboard surfaces with said inboard surface projecting in a direction of said lower form; and wet concrete between said lower form and said upper form;

wherein said drum is positioned on an upper surface of said lower form, one of said first curb profiling drum and said drive shaft is positioned on an upper surface of said upper form, and said first guide flange engages said outboard surface of said upper form.

13. A curbing system comprising:

the curb former of Paragraph 11;

a lower form;

an upper form that is spaced from said lower form and that extends to a higher elevation than said lower form; and wet concrete between said lower form and said upper form;

wherein said drum is positioned on an upper surface of said lower form, said sleeve is positioned on an upper surface of said upper form, and an upper section of said upper form is positioned between said first and second guide flanges.

14. The curbing system of any of Paragraphs 12-13, wherein a maximum spacing between said lower form and said upper form is 36".
15. The curbing system of any of Paragraphs 12-14, wherein said drum defines a gutter and said first curb profiling drum defines a curb that is integral with said gutter.
16. The curb former of any of Paragraphs 7-11, wherein said drum comprises first and second drum ends that are spaced from one another along said drive shaft, wherein a first drive shaft section extends beyond said first drum end in a direction that is away from said second drum end, wherein a second drive shaft section extends beyond said second drum end in a direction that is away from said first drum end, wherein a length of said first drive shaft section and a length of said second drive shaft section each accommodate installation of both said first curb profiling drum and said guide thereon, and wherein said first curb profiling drum and said guide are positioned on a common one of said first drive shaft section and said second drive shaft section.
17. The curb former of Paragraph 16, wherein said first drive shaft section comprises a first drive input and wherein said second drive shaft section comprises a second drive input.
18. The curb former of Paragraph 17, wherein said first drive input is on a first free end of said first drive shaft section and said second drive input is on a second free end of said second drive shaft section.
19. The curb former of any of Paragraphs 17-18, further comprising a drive assembly, a first drive configuration, and a second drive configuration, wherein said first drive configuration comprises said drive assembly interfacing with said first drive input of said first drive shaft section, and wherein said second drive configuration comprises said drive assembly interfacing with said second drive input of said second drive shaft section.
20. The curb former of any of Paragraphs 1-11, wherein said drum comprises first and second drum ends that are spaced from one another along said drive shaft, wherein a first drive shaft section extends beyond said first drum end in a direction that is away from said second drum end, wherein a second drive shaft section extends beyond said second drum end in a direction that is away from said first drum end, and wherein said first curb profiling drum is positioned on said first drive shaft section.
21. The curb former of Paragraph 20, wherein said first drive shaft section comprises a first drive input and wherein said second drive shaft section comprises a second drive input.
22. The curb former of Paragraph 21, wherein said first drive input is on a first free end of said first drive shaft section and said second drive input is on a second free end of said second drive shaft section.
23. The curb former of any of Paragraphs 21-22, further comprising a drive assembly, a first drive configuration, and a second drive configuration, wherein said first drive configuration comprises said drive assembly interfacing with said first drive input of said first drive shaft section, and wherein said second drive configuration comprises said drive assembly interfacing with said second drive input of said second drive shaft section.

24. The curb former of any of Paragraphs 20-23, wherein said curb former comprises a second curb profiling drum positioned on said second drive shaft section and detachably mounted relative to each of said drive shaft and said drum.

25. The curb former of any of Paragraphs 1-11, wherein said drum comprises first and second drum ends that are spaced from one another along said drive shaft, wherein said drive shaft extends at least 2 feet beyond said first drum end in a direction that is away from said second drum end, and wherein said drive shaft extends at least 2 feet beyond said second drum end in a direction that is away from said first drum end.

26. The curb former of any of Paragraphs 1-11 and 16-25, wherein said drum and said first curb profiling drum each comprise a perimeter surface that contacts wet concrete when forming a curb with said curb former, and wherein said perimeter surface of said drum and said perimeter surface of said first curb profiling drum are each concentrically disposed relative to a rotational axis of said drive shaft.

27. A curb former, comprising:

a drive shaft;

a drum mounted on said drive shaft and comprising first and second drum ends that are spaced from one another along said drive shaft, wherein a first drive shaft section extends beyond said first drum end in a direction that is away from said second drum end, and wherein a second drive shaft section extends beyond said second drum end in a direction that is away from said first drum end;

a first curb profiling drum positioned on said first drive shaft section and disposed in one of closely spaced or abutting relation to said first drum end; and a second curb profiling drum positioned on said second drive shaft section and disposed in one of closely spaced or abutting relation to said second drum end.

28. The curb former of Paragraph 27, wherein said drive shaft comprises a screed roller.

29. The curb former of any of Paragraphs 27-28, wherein said drum is fixedly attached to said drive shaft.

30. The curb former of any of Paragraphs 27-29, wherein said drum is welded to said drive shaft.

31. The curb former of any of Paragraphs 27-30, wherein said drum is a gutter drum.

32. The curb former of any of Paragraphs 27-31, wherein at least one of said first and second curb profiling drums is detachably mounted relative to each of said drive shaft and said drum 33. The curb former of any of Paragraphs 27-32, further comprising a first plurality of fasteners that secure said first curb profiling drum to said drum and a second plurality of fasteners that secure said second curb profiling drum to said drum.

34. The curb former of any of Paragraphs 27-33, further comprising a guide detachably mounted on said drive shaft, wherein said first curb profiling drum is located between said drum and said guide along said drive shaft.

35. The curb former of Paragraph 34, wherein said guide clamps onto said drive shaft.

36. The curb former of any of Paragraphs 34-35, wherein said guide comprises first and second split clamp rings that are spaced from one another along said drive shaft.

37. The curb former of any of Paragraphs 34-36, wherein said guide is disposable at each of a plurality of different positions along said drive shaft to accommodate different spacings between said first curb profiling drum and said guide along said drive shaft, and wherein said guide is securable to said drive shaft at each of said plurality of different positions.

The curb former of any of Paragraphs 34-37, wherein said guide comprises a sleeve, a first guide flange that extends radially outwardly relative to said sleeve, and a second guide flange that is spaced from said first guide flange and that also extends radially outwardly relative to said sleeve, and wherein said first guide flange is located between said second guide flange and said first curb profiling drum.

39. A curbing system comprising:

the curb former of Paragraph 38;

a lower form;

an upper form spaced from said lower form, that extends to a higher elevation than said lower form, and that comprises inboard and outboard surfaces with said inboard surface projecting in a direction of said lower form; and wet concrete between said lower form and said upper form;

wherein said drum is positioned on an upper surface of said lower form, one of said first curb profiling drum and said drive shaft is positioned on an upper surface of said upper form, and said first guide flange engages said outboard surface of said upper form.

40. A curbing system comprising:

the curb former of Paragraph 38;

a lower form;

an upper form spaced from said lower form and that extends to a higher elevation than said lower form; and wet concrete between said lower form and said upper form;

wherein said drum is positioned on an upper surface of said lower form, said sleeve is positioned on an upper surface of said upper form, and an upper section of said upper form is positioned between said first and second guide flanges.

41. The curbing system of any of Paragraphs 39-40, wherein a maximum spacing between said lower form and said upper form is 36".

42. The curbing system of any of Paragraphs 39-41, wherein said drum defines a gutter and said first curb profiling drum defines a curb that is integral with said gutter.

43. The curb former of any of Paragraphs 27-38, wherein said first drive shaft section comprises a first drive input and wherein said second drive shaft section comprises a second drive input.

44. The curb former of Paragraph 43, wherein said first drive input is on a first free end of said first drive shaft section and said second drive input is on a second free end of said second drive shaft section.

45. The curb former of any of Paragraphs 43-44, further comprising a drive assembly, a first drive configuration, and a second drive configuration, wherein said first drive configuration comprises said drive assembly interfacing with said first drive input of said first drive shaft section, and wherein said second drive configuration comprises said drive assembly interfacing with said second drive input of said second drive shaft section.

46. The curb former of any of Paragraphs 27-38 and 43-45, wherein said drum and said first curb profiling drum each comprise a perimeter surface that contacts wet concrete when forming a curb with said curb former, and wherein said perimeter surface of said drum and said perimeter surface of said first curb profiling drum are each concentrically disposed relative to a rotational axis of said drive shaft.

47. A rotary screed, comprising:

a drive shaft; and a drum assembly mounted on said drive shaft and comprising first and second drum ends that are spaced along said drive shaft by a distance of at least 5 feet, wherein said drum assembly comprises:

a first curb forming section comprising a first curb profiling surface; and a lane forming section comprising a lane profiling surface, wherein said lane forming section extends from said first curb forming section toward said second drum end, and wherein said lane profiling surface is cylindrical.

48. The rotary screed of Paragraph 47, wherein said drive shaft comprises a screed roller.

49. The rotary screed of any of Paragraphs 47-48, wherein said drum assembly comprises a drum and a separate first curb profiling drum, and wherein said lane forming section comprises said drum and said first curb forming section comprises said first curb profiling drum.

50. The rotary screed of Paragraph 49, wherein said drum is fixedly attached to said drive shaft.

51. The rotary screed of any of Paragraphs 49-50, wherein said drum is welded to said drive shaft.

52. The rotary screed of any of Paragraphs 49-51, wherein said first curb profiling drum is detachably mounted relative to each of said drive shaft and said drum, wherein adjacent end portions of said drum and said first curb profiling drum are disposed in at least one of closely spaced or abutting relation.

53. The rotary screed of Paragraph 52, further comprising a plurality of fasteners that secure said first curb profiling drum to said drum.

54. The rotary screed of any of Paragraphs 47-53, further comprising a guide detachably mounted on said drive shaft, wherein said first curb forming section is located between said guide and said lane forming section along said drive shaft.

55. The rotary screed of Paragraph 54, wherein said guide clamps onto said drive shaft.

56. The rotary screed of any of Paragraphs 54-55, wherein said guide comprises first and second split clamp rings that are spaced from one another along said drive shaft.

57. The rotary screed of any of Paragraphs 54-56, wherein said guide is disposable at each of a plurality of different positions along said drive shaft to accommodate different spacings between said first curb profiling surface and said guide along said drive shaft, and wherein said guide is securable to said drive shaft at each of said plurality of different positions.

58. The rotary screed of any of Paragraphs 54-57, wherein said guide comprises a sleeve, a first guide flange that extends radially outwardly relative to said sleeve, and a second guide flange that is spaced from said first guide flange and that also extends radially outwardly relative to said sleeve, and wherein said first guide flange is located between said second guide flange and said first curb forming section.

59. A system comprising:

the rotary screed of Paragraph 58;

a lower support;

an upper support that is spaced from said upper form by a distance of at least 5 feet, that extends to a higher elevation than said lower support, and that comprises inboard and outboard surfaces with said inboard surface projecting in a direction of said lower support; and wet concrete between said lower support and said upper support;

wherein said drum assembly is positioned on an upper surface of said lower support, one of said drum assembly and said drive shaft is positioned on an upper surface of said upper support, and said first guide flange engages said outboard surface of said upper support.

60. A system comprising:

the rotary screed of Paragraph 58;

a lower support;

an upper support that is spaced from said lower support by distance of at least 5 feet and that extends to a higher elevation than said lower support; and wet concrete between said lower support and said upper support;

wherein said drum assembly is positioned on an upper surface of said lower support, said sleeve is positioned on an upper surface of said upper support, and an upper section of said upper support is positioned between said first and second guide flanges.

61. The system of any of Paragraphs 59-60, wherein said lower support is selected from the group consisting of a form, a screed pole, a screed pipe, and an existing lane.

62. The system of any of Paragraphs 59-61, wherein said first curb profiling surface of said drum assembly defines a curb and a portion of said lane profiling surface of said drum assembly that contacts said wet concrete defines a new lane that is integral with said curb.

63. The system of Paragraph 62, wherein said new lane is selected from the group consisting of a single lane of road, street, highway, or cart path.

64. The rotary screed of any of Paragraphs 54-58, wherein said first curb forming section comprises said first drum end, wherein a first drive shaft section extends beyond said first drum end in a direction that is away from said second drum end, wherein a second drive shaft section extends beyond said second drum end in a direction that is away from said first drum end, wherein a length of said first drive shaft section and a length of said second drive shaft section each accommodate installation of said guide thereon, and wherein said guide is positioned on said first drive shaft section.

65. The rotary screed of Paragraph 64, wherein said first drive shaft section comprises a first drive input and wherein said second drive shaft section comprises a second drive input.

66. The rotary screed of Paragraph 65, wherein said first drive input is on a first free end of said first drive shaft section and said second drive input is on a second free end of said second drive shaft section.

67. The rotary screed of any of Paragraphs 65-66, further comprising a drive assembly, a first drive configuration, and a second drive configuration, wherein said first drive configuration comprises said drive assembly interfacing with said first drive input of said first drive shaft section, and wherein said second drive configuration comprises said drive assembly interfacing with said second drive input of said second drive shaft section.

68. The rotary screed of any of Paragraphs 65-66, further comprising a first drive assembly and a second drive assembly, wherein said drive assembly interfaces with said first drive input of said first drive shaft section and said second drive assembly interfaces with said second drive input of said second drive shaft section, wherein each of said first drive assembly and said second drive assembly separately rotate said drive shaft in a first direction to thereby rotate said drum assembly in the same said first direction.

69. The rotary screed of any of Paragraphs 47-58, wherein said first curb forming section comprises said first drum end, wherein a first drive shaft section extends beyond said first drum end in a direction that is away from said second drum end, and wherein a second drive shaft section extends beyond said second drum end in a direction that is away from said first drum end.

70. The rotary screed of Paragraph 69, wherein said first drive shaft section comprises a first drive input and wherein said second drive shaft section comprises a second drive input.

71. The rotary screed of Paragraph 70, wherein said first drive input is on a first free end of said first drive shaft section and said second drive input is on a second free end of said second drive shaft section.

72. The rotary screed of any of Paragraphs 70-71, further comprising a drive assembly, a first drive configuration, and a second drive configuration, wherein said first drive configuration comprises said drive assembly interfacing with said first drive input of said first drive shaft section, and wherein said second drive configuration comprises said drive assembly interfacing with said second drive input of said second drive shaft section.

73. The rotary screed of any of Paragraphs 70-71, further comprising a first drive assembly and a second drive assembly, wherein said drive assembly interfaces with said first drive input of said first drive shaft section and said second drive assembly interfaces with said second drive input of said second drive shaft section, wherein each of said first drive assembly and said second drive assembly separately rotate said drive shaft in a first direction to thereby rotate said drum assembly in the same said first direction.

74. The rotary screed of any of Paragraphs 69-73, wherein said drum assembly comprises a second curb forming section comprising a second curb profiling surface, wherein said lane forming section extends between first curb forming section and said second curb forming section.

75. The rotary screed of any of Paragraphs 47-58, wherein said drive shaft extends at least 2 feet beyond said first drum end in a direction that is away from said second drum end, and wherein said drive shaft extends at least 2 feet beyond said second drum end in a direction that is away from said first drum end.

76. The rotary screed of any of Paragraphs 47-58, further comprising a drive assembly detachably connectable with said drive shaft.

77. The rotary screed of any of Paragraphs 47-58, wherein an end of said drive shaft comprises a drive input, and wherein said rotary screed further comprises a drive assembly that interfaces with said drive input.

78. The rotary screed of any of Paragraphs 47-58 and 64-77, wherein said lane profiling surface and said first curb profiling surface are each concentrically disposed relative to a rotational axis of said drive shaft.

DETAILED DESCRIPTION

Figure 1:
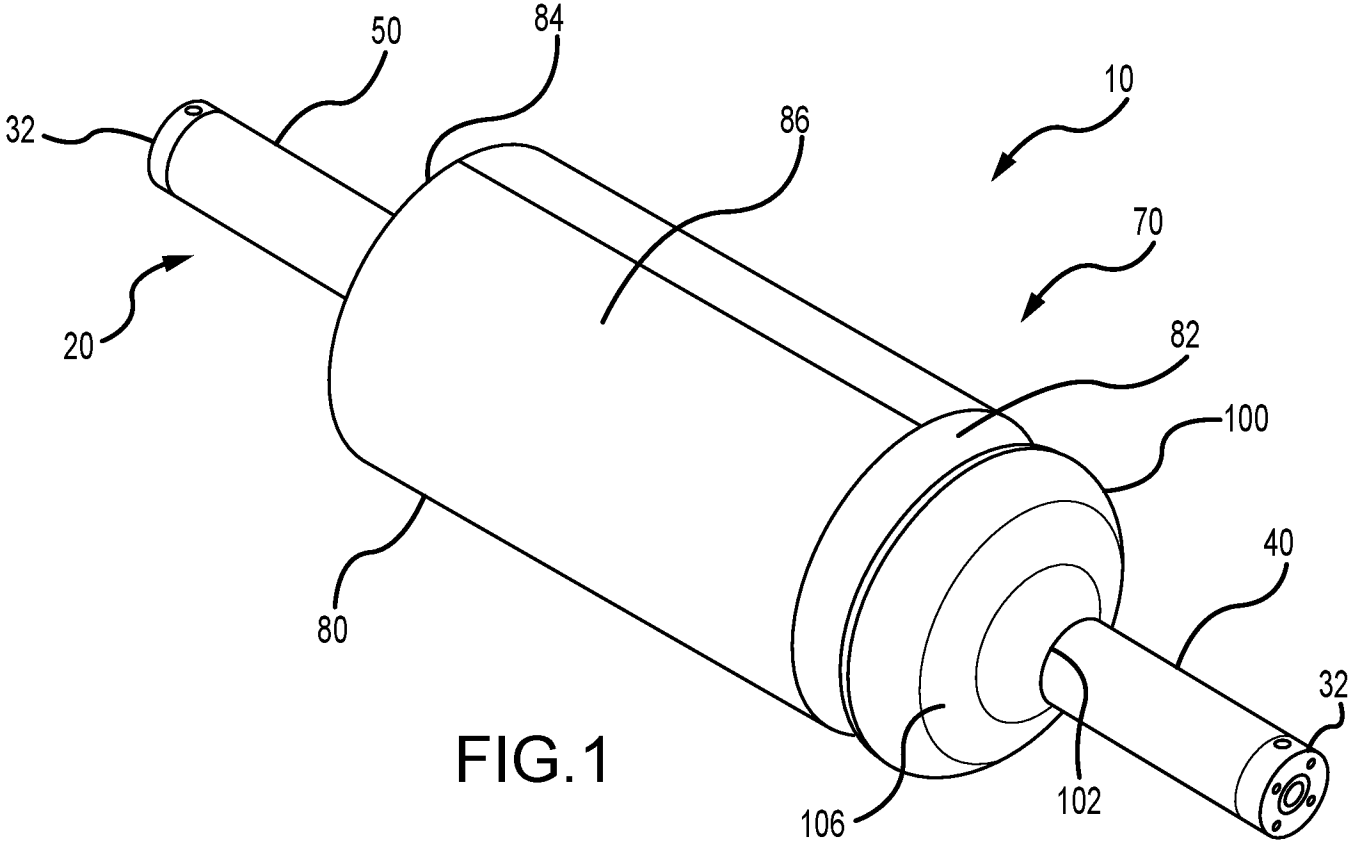
FIG. 1 is a perspective view of one embodiment of a curb former that utilizes a removable curb profiling drum.
Figure 2:
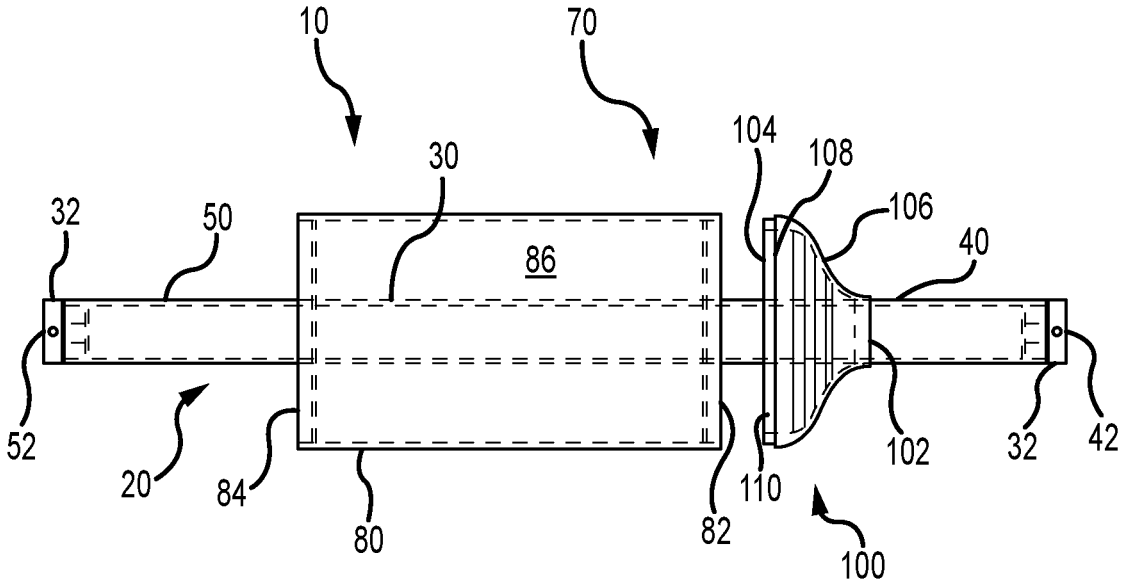
FIG. 2 is a partially exploded side view of the curb former of FIG. 1.
Figure 3:
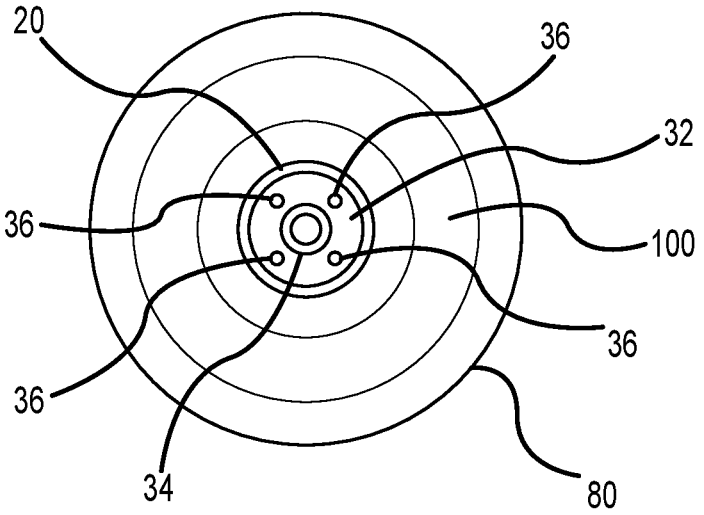
FIG. 3 is an end view of the curb former of FIG. 1.

FIGS. 1-3 illustrate one embodiment of a curb former that is identified by reference numeral 10. The curb former 10 include a drive shaft or tube 20 and a drum assembly 70 that are collectively rotatable in a common direction (e.g., the drive shaft 20 and drum assembly 70 simultaneously rotate in a common direction and at a common rotational speed). The drive shaft 20 may be of any appropriate configuration for imparting a rotational force/rotational motion to the drum assembly 70. The illustrated embodiment has the drive shaft 20 being in the form of a rotatable screed roller of a type disclosed in U.S. Pat. No. 7,544,012, the entire disclosure of which is incorporated by reference.

The illustrated embodiment has the drive shaft 20 including a tube body 30 having a first free end 42 and a second free end 52 that are disposed opposite of one another (e.g., spaced along a length or length dimension of the drive shaft 20, which may coincide with a rotational axis of the drive shaft). The tube body 30 may have a cylindrical perimeter. Separate plugs 32 are disposed at both the first free end 42 and the second free end 52, with each plug 32 being maintained in a fixed position relative to the tube body 30 in any appropriate manner (e.g., welded). Each of these plugs 32 includes structure to allow the corresponding end of the drive shaft 20 to be driven by an appropriate rotational drive/drive assembly (e.g., FIGS. 13A-D; 14A; 14B). As such, the first free end 42 may be characterized as a first drive input for the drive shaft 20, while the second free end 52 may be characterized as a second drive input for the drive shaft 20. Such a drive input for each plug 32 includes a recess 34 and a plurality of threaded holes 36 for interfacing with a rotational drive/drive assembly at least generally of the type shown in FIGS. 13A-14B.

The drum assembly 70 is configured to simultaneously form an integral curb and gutter (i.e., such that there is no joint of any kind between the curb and gutter), and furthermore to produce various different profiles for the curb portion of an integral curb and gutter. In this regard, the drum assembly 70 includes a drum 80. This drum 80 is configured to form the gutter portion of an integral curb and gutter, and thereby may be referred to as a "gutter drum 80." A first drum end 82 and a second drum end 84 for the gutter drum 80 are spaced from one another along the drive shaft 20 (e.g., along its length dimension). A drum body or gutter profiling surface 86 (e.g., a perimeter surface of the gutter drum 80) extends from the first drum end 82 to the second drum end 84 and is disposed about the drive shaft 20 (e.g., the gutter profiling surface 86 may be concentrically disposed relative to the drive shaft 20, particularly its rotational axis). The drive shaft 20 and the gutter drum 80 are fixed to one another in any appropriate manner (e.g. via one or more welds) such that the gutter drum 80 will rotate along with the drive shaft 20 when being rotated by an appropriate rotational drive source. In the illustrated embodiment, the perimeter of the drum body 86 is cylindrical, with the drive shaft 20 extending through the center of this cylinder 86 (e.g., the drum body 86 and the tube body 30 are concentrically disposed in the illustrated embodiment).

Figure 5:
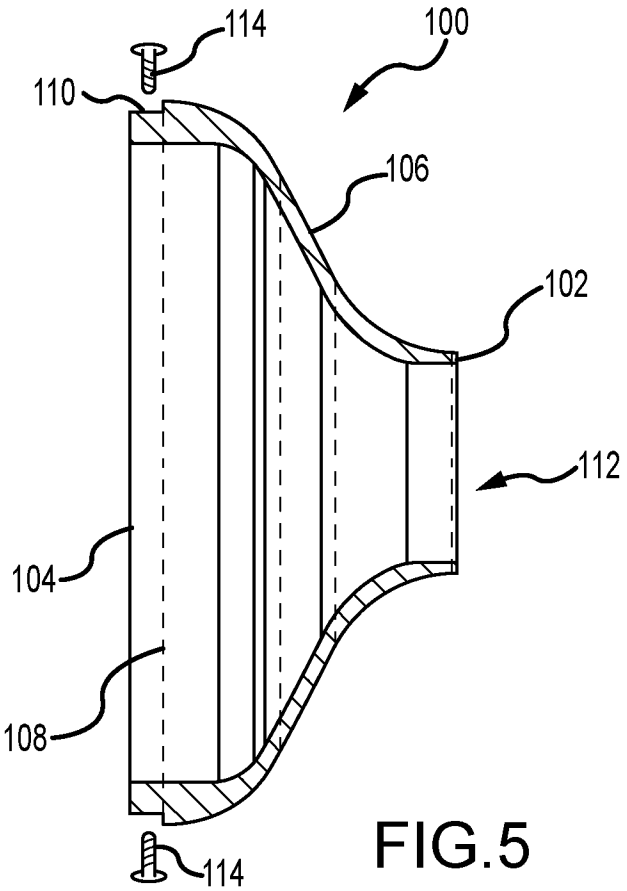
FIG. 5 is a cross-sectional view of the curb profiling drum of FIG. 4, taken along line 5-5.
Figure 4:
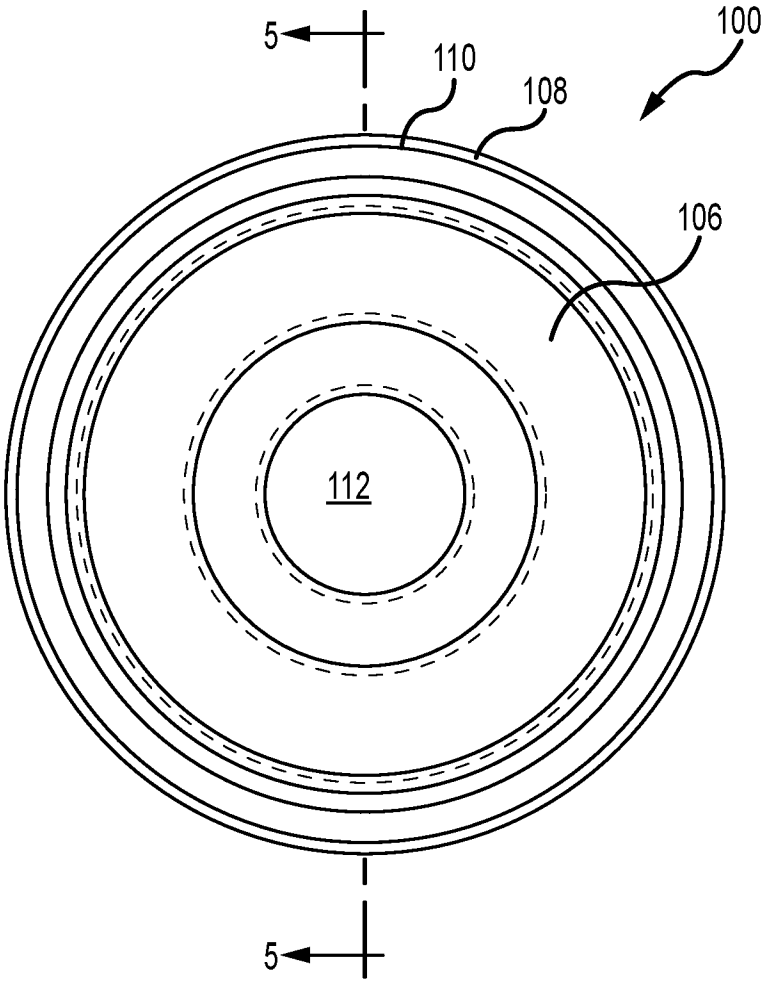
FIG. 4 is a view of an end of a curb profiling drum that is adjacent to a gutter drum for the curb former of FIG. 1.

Another component of the drum assembly 70 is a curb profiling drum 100 (e.g., a first curb profiling drum 100), which is shown in more detail in FIGS. 4 and 5, and which is used to define a curb portion of an integral curb and gutter. Notably, the curb profiling drum 100 is detachably connectable relative to both the gutter drum 80 and the drive shaft 20. Changing a curb profiling drum 100 of one profile for a curb profiling drum 100 of a different profile will therefore change the profile of the corresponding curb, while still being able to use the same gutter drum 80 and drive shaft 20. As such, the gutter drum 80 may also be referred to as a universal drum for the curb former 10 (or more generally as a "first drum 80"). A curb forming kit could include an assembly in the form of a gutter drum 80 that is fixed to the drive shaft 20, and a plurality of curb profiling drums 100 of different profiles. Generally, the curb profiling drum 100 and the gutter drum 80 are disposed at different positions along the drive shaft 20 (e.g., along its length or length dimension), with an end portion of the curb profiling drum 100 (e.g., shoulder 108 discussed below) being disposed in closely spaced or abutting relation to the first drum end 82 of the gutter drum 80.

Enlarged views of the curb profiling drum 100 for the curb former 10 are presented in FIGS. 4 and 5. A first drum end 102 and a second drum end 104 for the curb profiling drum 100 are spaced from one another along the drive shaft 20 when in an installed configuration. A curb profiling surface 106 extends at least the majority of the distance between the first drum end 102 and the second drum and 104 of the curb profiling drum 100. In the illustrated embodiment, the curb profiling surface 106 extends from a shoulder 108 (proximate the second drum end 104) to the first drum end 102. The curb profiling surface 106 may be of any appropriate shape or configuration, and will typically define the shape of at least the "riser" or sidewall of a curb (e.g., a portion of the curb that extends at least generally in the vertical dimension; see FIGS. 15A-H, addressed below). The curb profiling surface 106 (e.g., a perimeter surface of the curb profiling drum 100) is disposed about the drive shaft 20 (e.g., the curb profiling surface 106 may be concentrically disposed relative to the drive shaft 20, particularly its rotational axis). Preferably the curb profiling surface 106 of the curb profiling drum 100 extends from the gutter profiling surface 86 of the gutter drum 80, although there could be one or more small gaps therebetween proceeding about the perimeter.

An outer diameter of the gutter drum 80 is larger than the outer diameter of at least part of the curb profiling drum 100. At least part of the perimeter surface of the curb profiling drum 100 (e.g., at least part of its curb profiling surface 106) at least generally converges toward the drive shaft 20 in proceeding away from the gutter drum 100 and toward the corresponding end 42, 52 of the drive shaft 20 for the illustrated embodiment. At least part of the curb profiling surface 106 of the curb profiling drum 100 may be characterized as defining the profile of a riser or sidewall of a curb (e.g., FIGS. 15A-15H). In one embodiment, the outer diameter of at least part of the first curb profiling drum 100 (e.g., at the first drum end 102 of the curb profiling drum 100) is at least 3 inches less than an outer diameter of the drum 70, and which could be equated with minimum height of the riser or sidewall of the curb defined by the curb former 10 in at least certain instances.

An aperture 112 extends from the first drum end 102 to the second drum end 104 of the curb profiling drum 100 to accommodate the installation of the curb profiling drum 100 on the drive shaft 20. The inner diameter of the curb profiling drum 100 at its first end 102 may be at least generally the same as the outer diameter of the tube body 30 for the drive shaft 20, including where the inner diameter of the curb profiling drum 100 at its first end 102 is in contact with or is at least disposed in closely spaced with the tube body 30 when the curb profiling drum 100 is installed on the drive shaft 20. As noted above, the curb profiling drum 100 includes an annular shoulder 108 that is at least generally proximate to its second drum end 104. An inset 110 extends from this shoulder 108 and is disposed against (or is disposed in close proximity to) an interior surface at the first drum end 82 of the gutter drum 80. A plurality of fasteners 114 of any appropriate type extend through a sidewall of the gutter drum 80 (e.g., the drum body 86) and engage the inset 110 at a plurality of locations that are spaced about the drive shaft 20 to secure the curb profiling drum 100 to the gutter drum 80. The drive shaft 20, the gutter drum 80, and the curb profiling drum 100 will thereby collectively rotate in a common direction and at a common rotational velocity when the drive shaft 20 is rotated by an appropriate drive source.

The drive shaft 20 extends beyond the first drum end 82 of the gutter drum 80 (in a direction that is away from the second drum end 84) and that defines a first drive shaft section 40, and the drive shaft 20 also extends beyond the second drum end 84 of the gutter drum 80 (in a direction that is away from the first drum end 82) and that defines a second drive shaft section 50. The first drive shaft section 40 may be described as that portion of the drive shaft 20 that extends between the first drum end 82 and the first free end 42 of the drive shaft 20, while the second drive shaft section 50 may be described as that portion of the drive shaft 20 that extends between the second drum end 84 and the second free end 52 of the drive shaft 20. In the illustrated embodiment, the curb profiling drum 100 is disposed between the first drum end 82 of the gutter drum 80 and the first free end 42 of the drive shaft 20. Moreover, the drive shaft 20 extends beyond the first drum end 102 of the curb profiling drum 100 in a direction that is away from the second drum end 104 of the curb profiling drum 100.

Each of the first drive shaft section 40 and the second drive shaft section 50 may be of an appropriate length (measured along the drive shaft 20, or more specifically along its rotational axis), including where the length of drive shaft sections 40, 50 is the same and where they are of different lengths. One embodiment has each of the first drive shaft section 40 and the second drive shaft section 50 being at least two (2) feet in length. Preferably both the first drive shaft section 40 and the second drive shaft section 50 of the drive shaft 20 are of a length that accommodates installation of at least a curb profiling roller (e.g., curb profiling roller 100) thereon.

Figure 6:
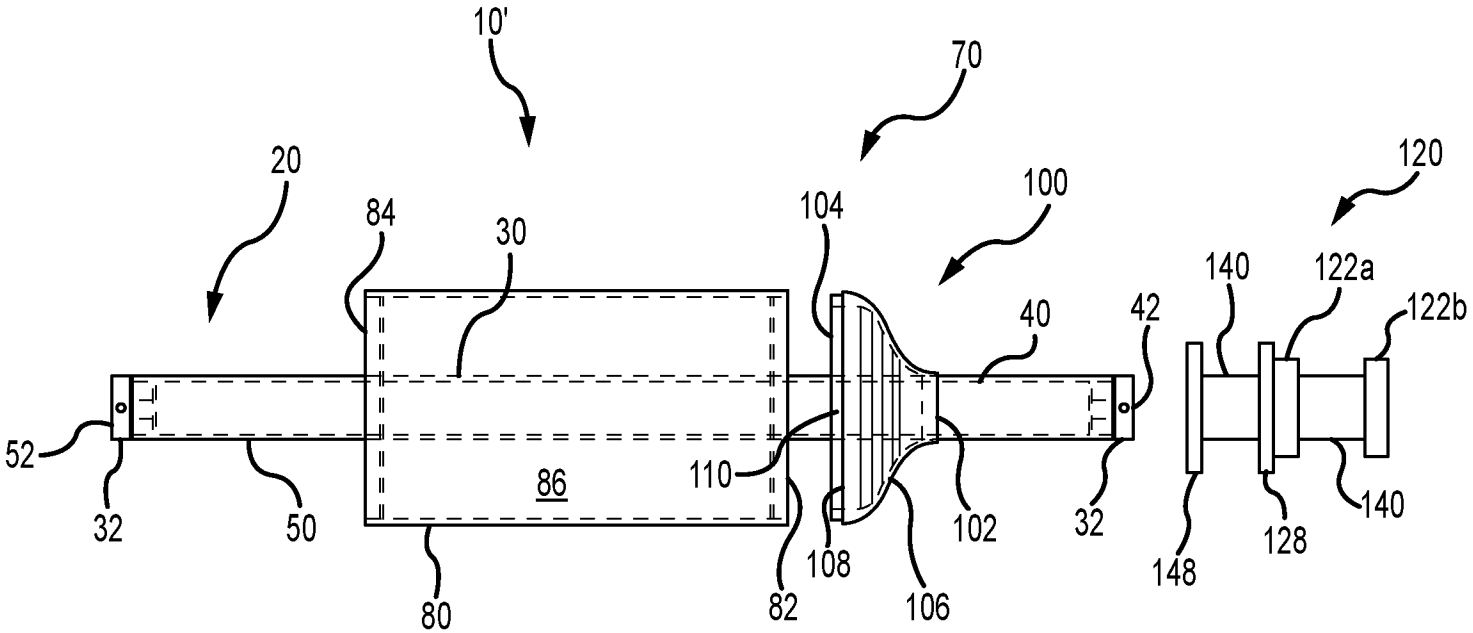
FIG. 6 is a partially exploded side view of a variation of the curb former of FIG. 1, namely a curb former that utilizes a removable guide.

Another embodiment of a curb former is illustrated in FIG. 6 and is identified by reference numeral 10'. Corresponding portions of the curb former 10' of FIG. 6 and the curb former 10 of FIGS. 1-3 are identified by the same reference numeral, and the discussion of these components with regard to the curb former 10 are equally applicable to the curb former 10' unless otherwise noted to the contrary. The primary difference between the curb former 10' of FIG. 6 and the curb former 10 of FIGS. 1-3 is the addition of a guide 120. Generally, the guide 120 is positioned on and rotates with the drive shaft 20 of the curb former 10' and is used by an operator so as to be able to advance the curb former 10' along a form assembly when defining at least a curb (e.g., form assembly 160 discussed below with regard to FIG. 11A) and to remain in at least substantial alignment with this form assembly. The curb profiling drum 100 is located between the gutter drum 80 and the guide 120 along the drive shaft 20. In the illustrated embodiment, both the curb profiling drum 100 and the guide 120 are disposed on the first drive shaft section 40 of the drive shaft 20. Preferably both the first drive shaft section 40 and the second drive shaft section 50 of the drive shaft 20 are of a length that accommodates installation of both a curb profiling roller (e.g., curb profiling roller 100) and a guide 120 thereon in the case of the curb former 10' (i.e., as an alternative to what is shown in FIG. 6, the curb profiling roller 100 and guide 120 could both be positioned on the second drive shaft section 50 of the drive shaft 20).

Additional views of the guide 120 are presented in FIGS. 7-10. The guide 120 includes a pair of split clamp rings 122*a*, 122*b* that are spaced along and appropriately fixed (e.g., welded) to a sleeve 140 (as such the clamp rings 122*a* and 122*b* are also spaced along the drive shaft 20 when the guide 120 is in an installed configuration). A guide flange 148 is fixed to one end (or end portion) of the sleeve 140, with the guide flange 148 extending radially outwardly relative to the sleeve 140. Both the sleeve 140 and the guide flange 148 include a split line 142. This allows opposing edges of the sleeve 140 and guide flange 148 to be moved away from one another along the split line 142, and also to be moved toward one another.

Figure 8:
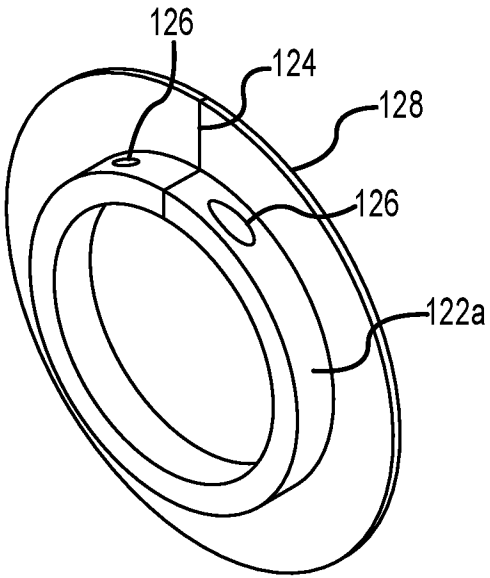
FIG. 8 is a perspective view of a clamping ring having an integral guide flange, and that is utilized by the guide of FIG. 7.
Figure 7:
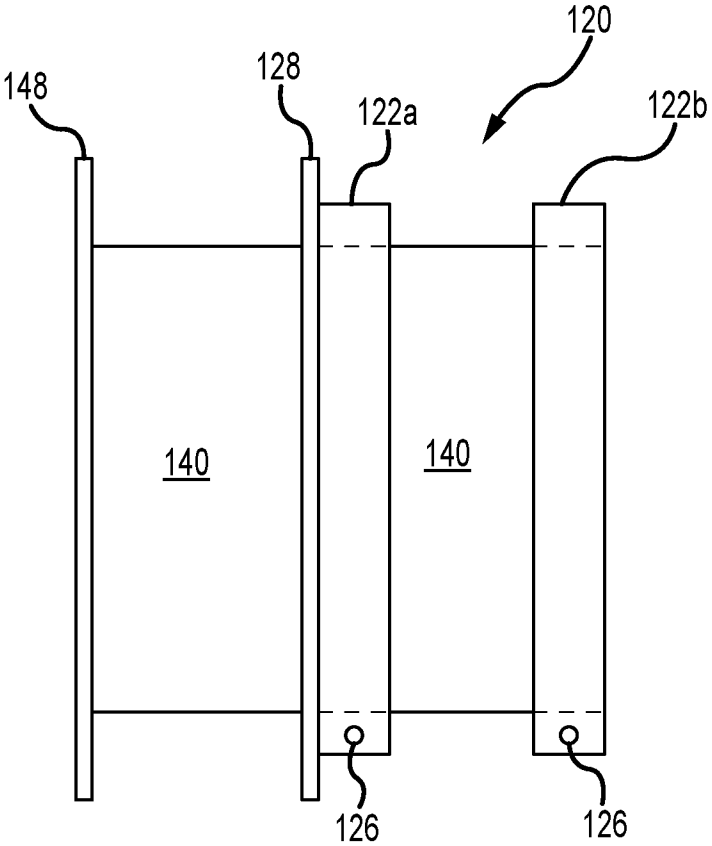
FIG. 7 is a side view of the removable guide utilized by the curb former of FIG. 6.
Figure 10:
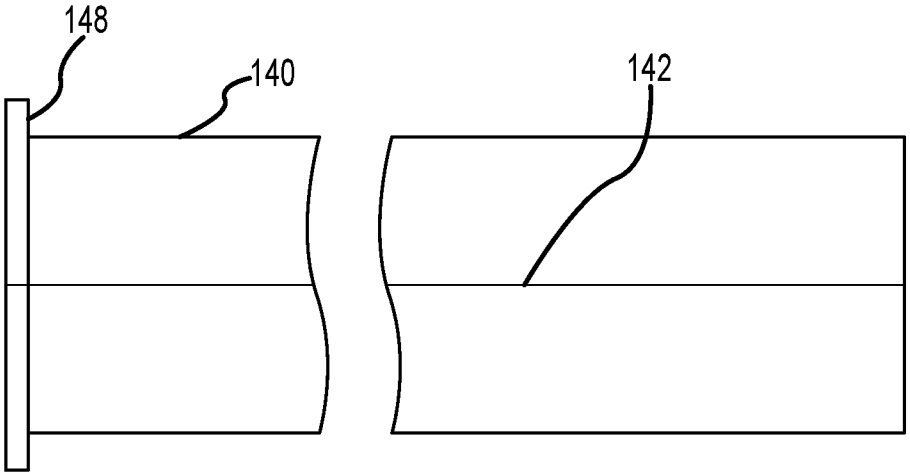
FIG. 10 is a side view of a sleeve having an integral guide flange, and that is utilized by the guide of FIG. 7.
Figure 9:
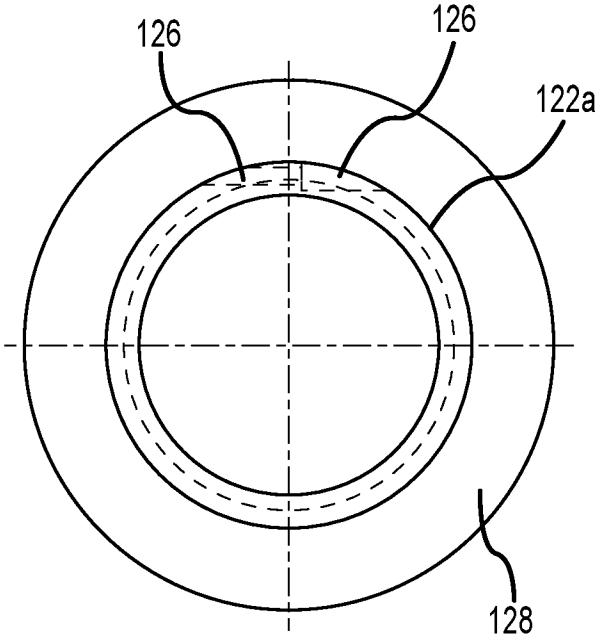
FIG. 9 is an end view of the clamping ring of FIG. 8.

A guide flange 128 is fixed to one end of the clamp ring 122*a*, with the guide flange 128 extending radially outwardly relative to the sleeve 140. Both the clamp ring 122*a* and the guide flange 128 include a split line 124. This allows opposing edges of the clamp ring 122*a* and its corresponding guide flange 128 to be moved away from one another along the split line 124, and also to be moved toward one another. In this regard and as shown in FIGS. 8 and 9, the clamp ring 122*a* includes a pair of clamping apertures 126, with one clamping aperture 126 being disposed at least generally adjacent to and on one side of the split line 124, and with the other clamping aperture 126 being disposed at least generally adjacent to and on the opposite side of the split line 124. The clamp ring 122*b* also includes a pair of such clamping apertures and a split line (not shown). As such, the entirety of the guide 120 is split along its length dimension.

The guide 120 may be positioned on and detachably mounted/secured to the drive shaft 20 of the curb former 10' at each of a plurality of different positions along the length of the drive shaft 20 (to thereby change the spacing between the guide 120 and the curb profiling drum 100, more specifically its first drum end 102). The spacing between the guide flange 148 and the first drum end 102 of the curb profiling drum 100 will define the width of the upper wall of a curb that is formed by the curb former 10'. Changing the spacing between the guide flange 148 and the first drum end 102 of the curb profiling drum 100 will change the width of the upper wall of a curb that is formed by the curb former 10', although such a curb will have the same profile for its "riser" or sidewall via the curb profiling surface 106 of the curb profiling drum 100. Nonetheless, the mere ability of the curb former 10' to change the spacing between the guide 120 and the curb profiling drum 100 allows for formation of a plurality of different curbs by the curb former 10' (where these curbs would differ from one another based upon having different widths for their respective upper walls).

At least a slight expansion of the guide 120 along the split lines 124, 142 may be required for the installation of the guide 120 on the drive shaft 20 (e.g., to increase an inner diameter of the guide 120). In any case, the opposing edges of the sleeve 140, clamp rings 122*a*, 122*b*, and guide flanges 128, 148 that define the corresponding split lines 124, 142 will typically be at least slightly spaced when the guide 120 is initially positioned on the drive shaft 20. The guide 120 may be slid or advanced along the length of the drive shaft 20 to a desired position relative to the curb profiling drum 100 (more specifically its first drum end 102). Appropriate fasteners (not shown) may be installed in the clamping apertures 126 of the two clamp rings 122*a*, 122*b* and may be activated to compress/clamp the guide 120 onto the drive shaft 20 of the curb former 10' such that the guide 120 will then collectively rotate with the drive shaft 20 (and the drum assembly 70) and in a common rotational direction. This compression or clamping of the guide 120 onto the drive shaft 20 may be achieved via a reduction of the inner diameter of the guide 120 through activation of the fasteners in the noted clamping apertures 126 of the two split clamp rings 122*a*, 122*b*.

Figure 11A:
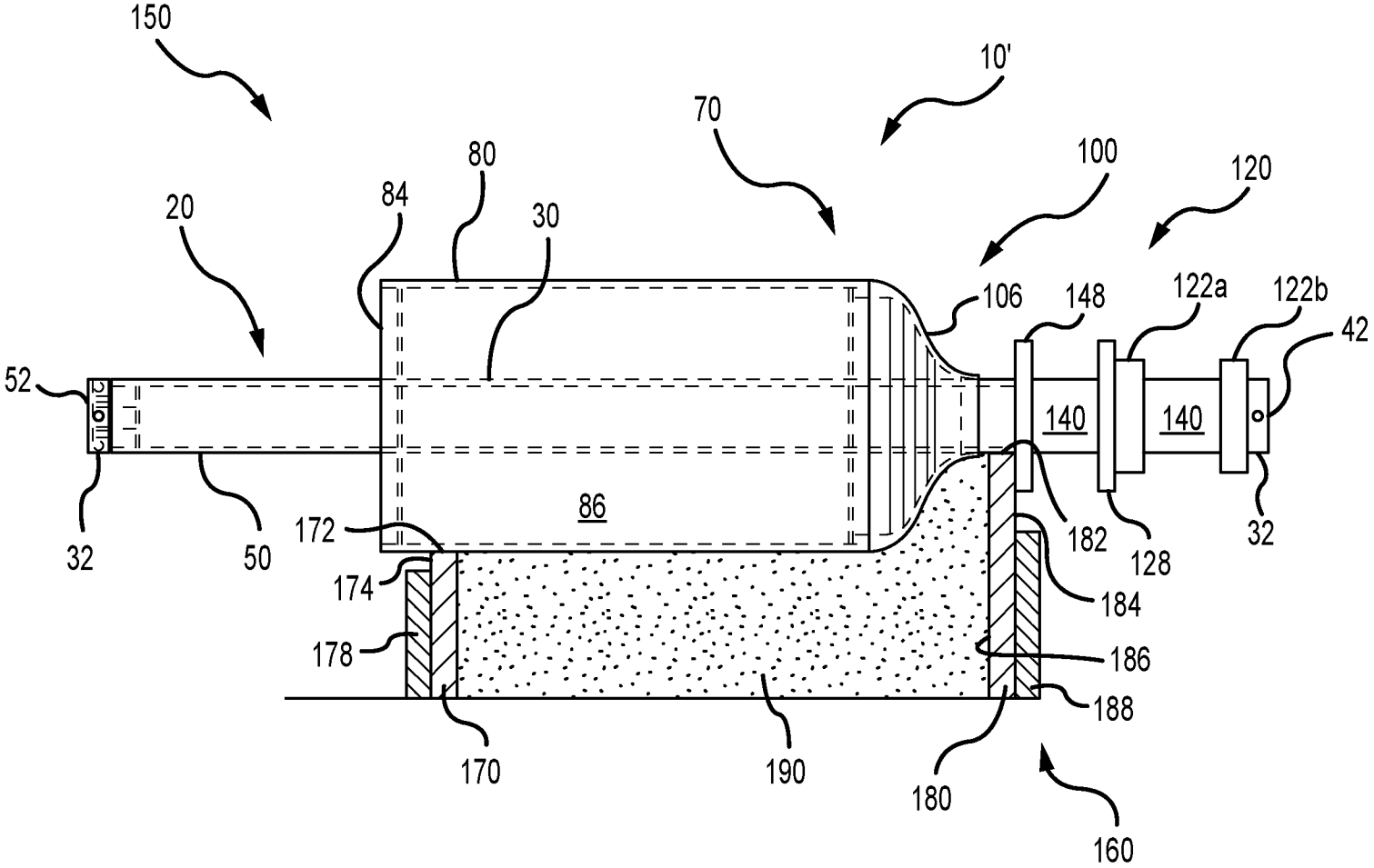
FIG. 11A is a side view of the curb former of FIG. 6 and a form assembly in relative position to form a representative integral curb and gutter configuration.

FIG. 11A shows the curb former 10' of FIG. 6 (in a side view) and a representative support or form assembly 160 (in cross section) to define an integral curb and gutter, and that may be collectively referred to as a curbing system 150. The form assembly 160 includes a lower support or form 170 and an upper support or form 180 that are spaced from one another in a lateral or horizontal dimension (the spacing between the lower form 170 and upper form 180 in FIG. 11A coinciding with this horizontal or lateral dimension). The length dimension for the lower form 170 and upper form 180 is orthogonal to the lateral dimension, and with a representative length dimension of the forms 170, 180 for the form assembly 160 being shown in FIG. 11B. The spacing between the lower form 170 and the upper form 180 may be at least substantially constant proceeding in the length dimension of the form assembly 160. Typically an appropriate rotational drive/drive assembly (e.g., FIGS. 13A-14B) would be interconnected with the first free end 42 of the drive shaft 20 of the curb former 10' to form an integral curb and gutter using the curb former 10' (such that an operator would walk on the outboard side of the upper form 180). However, such a rotational drive/drive assembly could instead be interconnected with the second free end 52 of the drive shaft 20 to form an integral curb and gutter using the curb former 10' (such that an operator would walk on the outboard side of the lower form 170). This would be applicable to the curb former 10 (FIG. 1) and the curb former 10" (FIG. 12) as well when forming an integral curb and gutter using the form assembly 160.

The lower form 170 includes an upper surface 172 and an outboard surface 174. A plurality of supports 178 are positioned along the length of the lower form 170 and engage the outboard surface 174 of the lower form 170. The upper form 180 includes an upper surface 182, an inboard surface 186, and an outboard surface 184. A plurality of supports 188 are positioned along the length of the upper form 180 and engage the outboard surface 184 of the upper form 180. The upper surface 182 of the upper form 180 is at a higher elevation than the upper surface 172 of the lower form 170 (e.g., the upper form 180 is taller in the vertical dimension compared to the lower form 170).

A typical spacing between the forms 170, 180 for forming an integral curb and gutter using any of the curb formers addressed herein is within a range of 18"-36", with a typical maximum spacing between the forms 170, 180 being about 36". The offset or "drop" in the vertical dimension between the upper surface 172 of the lower form 170 and the upper surface 182 of the upper form 180 may be of any appropriate value. A 6" offset or drop in the vertical dimension between the upper surface 172 of the lower form 170 and the upper surface 182 of the upper form 180 may be used to define curbs of the type shown in FIGS. 15A-15F and 15H, addressed below. Changing the amount of offset in the vertical dimension between the upper surface 172 of the lower form 170 and the upper surface 182 of the upper form 180 may be used to change the orientation of at least the base surface of the gutter (e.g., curb 400 shown in FIG. 15G, addressed below).

Concrete 190 is poured between the lower form 170 and the upper form 180 (this may be referred to as wet or poured concrete 190). The gutter drum 80 is positioned on the upper surface 172 of the lower form 170, while either the curb profiling drum 100, the drive shaft 20, or the sleeve 140 may be positioned on the upper surface 182 of the upper form 180. The position of the guide 120 along the drive shaft 20 may be adjusted to change the width of the upper wall of the resulting curb as noted above. Increasing the spacing between the first drum end 102 of the curb profiling drum 100 and the guide flange 148 of the guide 120 will increase the width of the upper wall of the resulting curb (assuming the forms 170 and 180 are correspondingly spaced), while decreasing the spacing between the first drum end 102 of the curb profiling drum 100 and the guide flange 148 of the guide 120 will decrease the width of the upper wall of the resulting curb (again, assuming the forms 170 and 180 are correspondingly spaced).

Figure 11B:
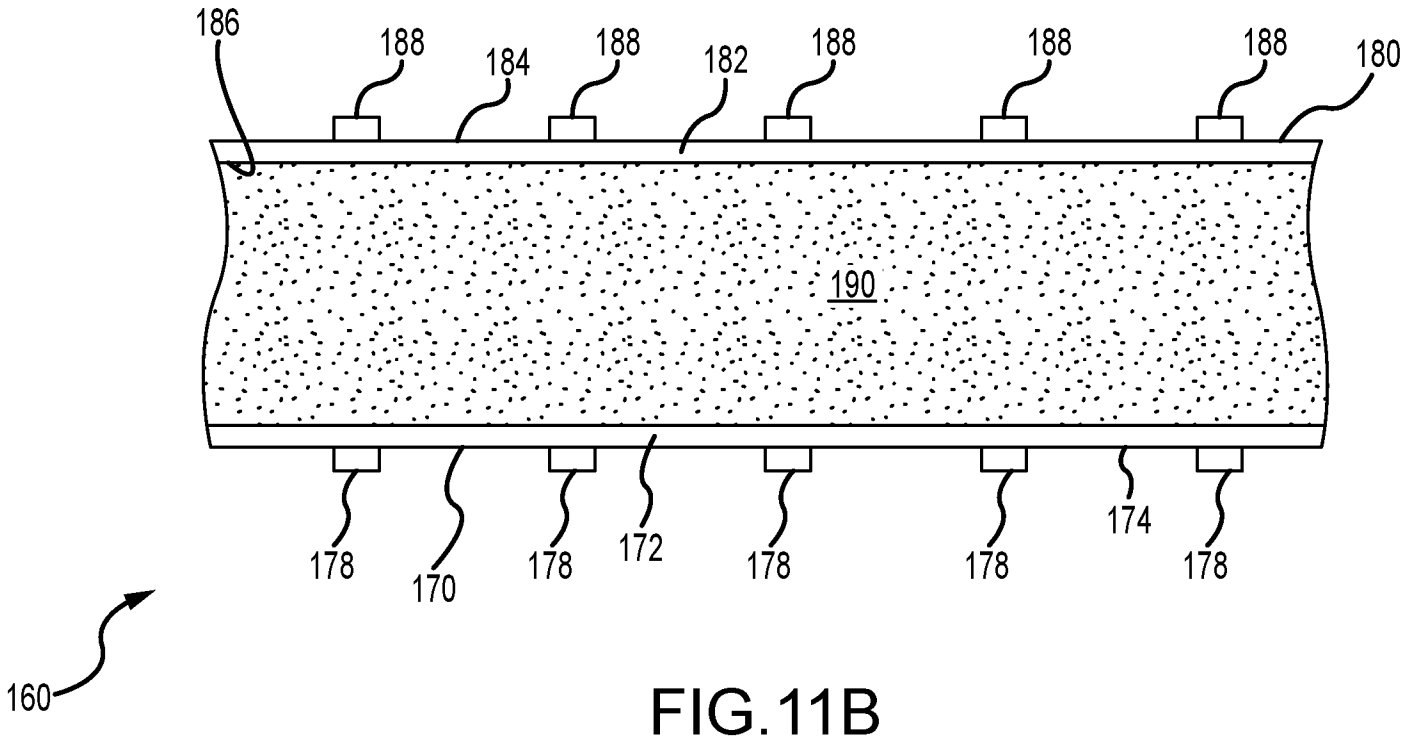
FIG. 11B is a representative top view of the form assembly of FIG. 11A.

The guide flange 148 may be positioned against the outboard surface 184 of the upper form 180 (FIG. 11A) to maintain the curb former 10' in proper alignment with the form assembly 160 as the curb former 10' is advanced by an operator along the length dimension of the form assembly 160 (FIG. 11B). In this case either an end portion of the curb profiling drum 100 or the drive shaft 20 would be positioned on the upper surface 182 of the upper form 180. Another option would be to position an upper section of the upper form 180 between the guide flange 148 and the guide flange 128 of the guide 120 to maintain the curb former 10' in proper alignment with the form assembly 160 as the curb former 10' is advanced by an operator along the length dimension of the form assembly 160 (not shown), in which case the sleeve 140 would be positioned on the upper surface 182 of the upper form 180. In any case, the curb former 10' is advanced along the form assembly 160 to form a curb. The curb former 10' is pulled in a first direction in the longitudinal or length dimension to form a curb using the form assembly 160. Rotation of the drive shaft 20 and drum assembly 70 would instead tend to advance the curb former 10' in an opposite second direction in the longitudinal or length dimension along the form assembly 160. This may also be described as advancing the curb former 10' against the rotational force of the drive shaft 20 and drum assembly 70, and in any case forms the integral curb and gutter by a screeding action relative to the wet concrete 190. This same basic operational principle would apply to the curb former 10 discussed above and to the curb former 10" that will now be addressed.

Figure 12:
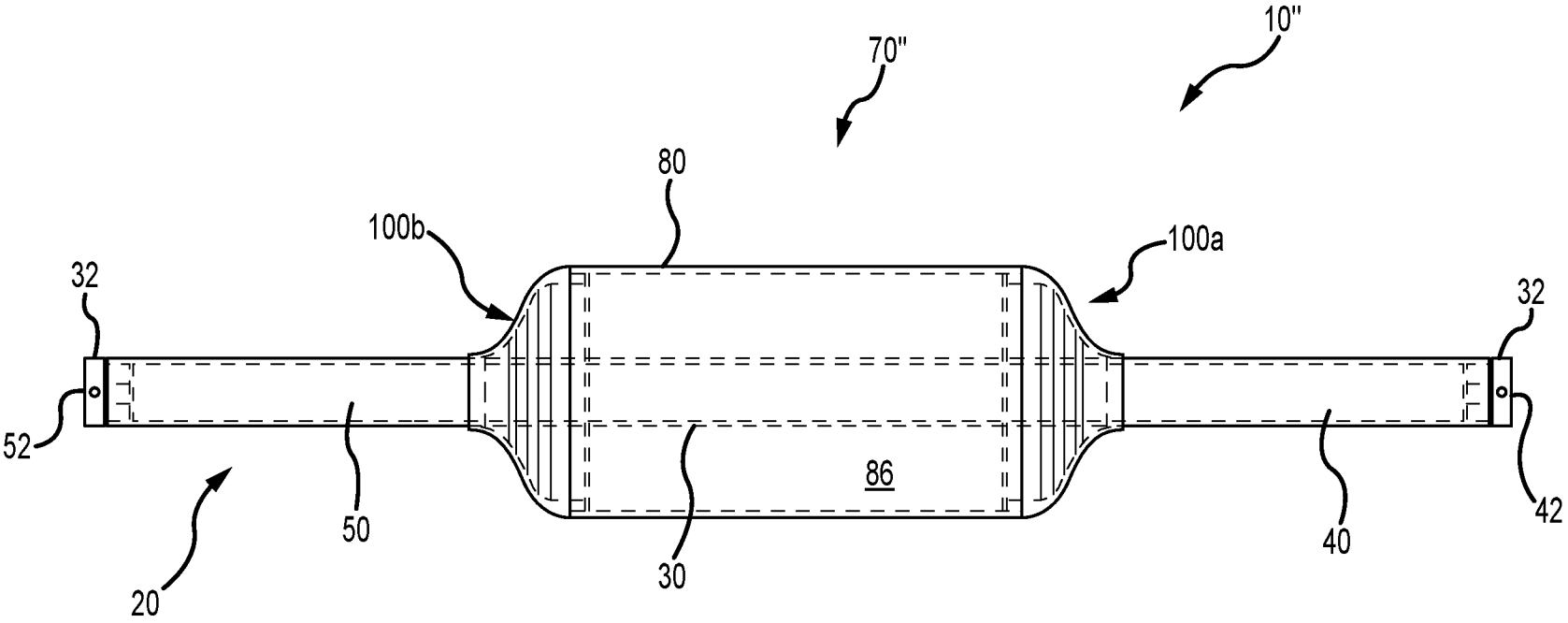
FIG. 12 is a side view of another variation of the curb former of FIG. 1.

Another embodiment of a curb former is illustrated in FIG. 12 and is identified by reference numeral 10". Corresponding portions of the curb former 10" of FIG. 12 and the curb former 10 of FIGS. 1-3 are identified by the same reference numeral, and the discussion of these components with regard to the curb former 10 are equally applicable to the curb former 10" unless otherwise noted to the contrary herein. The primary difference between the curb former 10" of FIG. 12 and the curb former 10 of FIGS. 1-3 is having a first curb profiling drum 100*a* on the first drive shaft section 40 and positioned against the first drum end 82 of the gutter drum 80, and having a second curb profiling drum 100*b* on the second drive shaft section 50 and positioned against the second drum end 84 of the gutter drum 80. As such, the drum assembly 70" of the curb former 10" of FIG. 12 differs from drum assembly 70 for the curb former 10 of FIGS. 1-3.

The shape of the curb profiling surface for the first curb profiling drum 100*a* may be different than the shape of the curb profiling surface for the second curb profiling drum 100*b*. As such, the first curb profiling drum 100*a* may be used to define a first profile for a curb using the curb former 70" (e.g., using the form assembly 160), while the second curb profiling drum 100*b* may be used to define a different second profile for a curb using the curb former 70" (e.g., using the form assembly 160). Although not shown, a guide 120 could be positioned on the first drive shaft section 40, a guide 120 could be positioned on the second drive shaft section 50, or both. In one embodiment, only one of the first curb profiling drum 100*a* or the second curb profiling drum 100*b* is used at a given point in time for a curbing operation by the curb former 10".

An appropriate rotational drive/drive assembly (e.g., FIGS. 13A-14B) could be interconnected with the first free end 42 of the drive shaft 20 of the curb former 10" to form a curb using the first curb profiling drum 100*a* (e.g., in combination with a form assembly 160, and such that an operator would walk on the outboard side of the upper form 180), although such a rotational drive/drive assembly could instead be interconnected with the second free end 52 of the drive shaft 20 to form a curb using the first curb profiling drum 100*a* (such that an operator would walk on the outboard side of the lower form 170). An appropriate rotational drive/drive assembly (e.g., FIGS. 13A-14B) could be interconnected with the second free end 52 of the drive shaft 20 of the curb former 10" to form a curb using the second curb profiling drum 100*b* (e.g., in combination with a form assembly 160, and such that an operator would walk on the outboard side of the upper form 180), although such a rotational drive/drive assembly could instead be interconnected with the first free end 42 of the drive shaft 20 to form a curb using the second curb profiling drum 100*b* (such that an operator would walk on the outboard side of the lower form 170).

FIGS. 13A-D show one embodiment of a rotational drive assembly 220 that may be used rotate the drive shaft 20 of a curb former of the type addressed herein. One end or end portion of the drive shaft 20 for the curb former may be attached to/interconnected with the drive assembly 220. The drive assembly 220 includes a drive motor 224, which in turn provides the rotational power to operate the curb former (more specifically to rotate the drive shaft 20). The drive motor 224 is fixed within the drive assembly 220 by the use of a motor frame 236 that also provides the point of fixed attachment for a handle assembly 226. The handle assembly 226 extends upward through an extension bar 228 from the motor frame 236 to position a control grip or handle 230 and a pull grip or handle 232 in a position so that the entire handle assembly 226 can be easily controlled by an operator. Finally, the power to the drive motor 224 is supplied through a power cord 242 by way of the control handle 230. The drive motor 224 may also be powered by an appropriate "on board" battery, an internal combustion engine, or any other appropriate power source.

To perform a curbing operation, the drive motor 224 is engaged by the use of the control handle 230, which in turn powers the drive shaft 20, which in turn rotates the drum assembly 70/70"/70*a*. As both the draft shaft 20 and drum assembly 70/70"/70*a* rotate in a common direction and at a common rotational speed, the operator of the drive assembly 220 pulls/moves the drum assembly 70/70"/70*a* in a direction that is opposite to the rotation of the drive shaft 20 over the unfinished concrete (e.g., rotation of the drum assembly 70/70"/70*a* would tend to move the drum assembly 70/70"/70*a* in a direction which is opposite to the direction that the operator pulls on the drum assembly 70/70"/70*a* for a curbing operation). This action has been found to be effective in producing the desired finish on the upper surface of the finished or screeded concrete that defines the curb, while also causing the concrete to compact to a desired consistency.

Figure 13A:
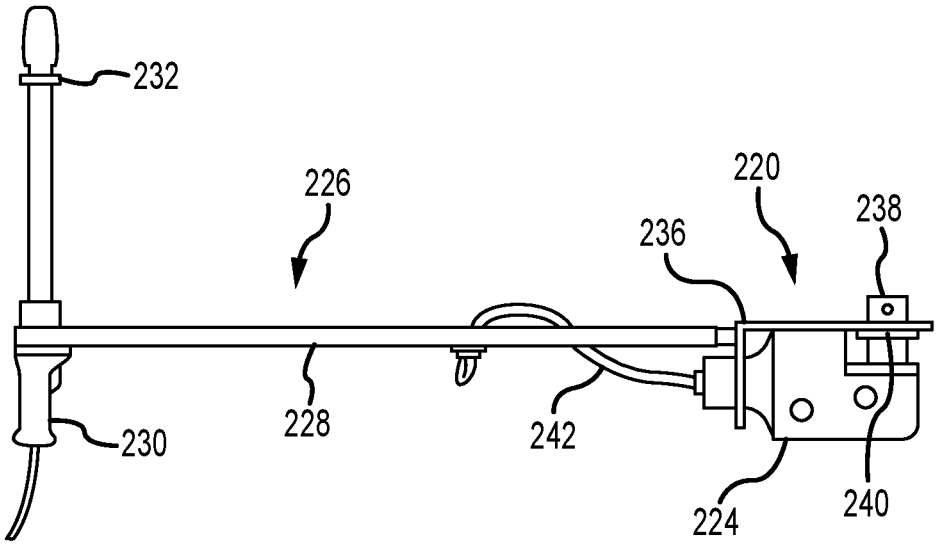
FIG. 13A is a top elevation view of one embodiment of a rotational drive for a curb former.
Figure 13B:
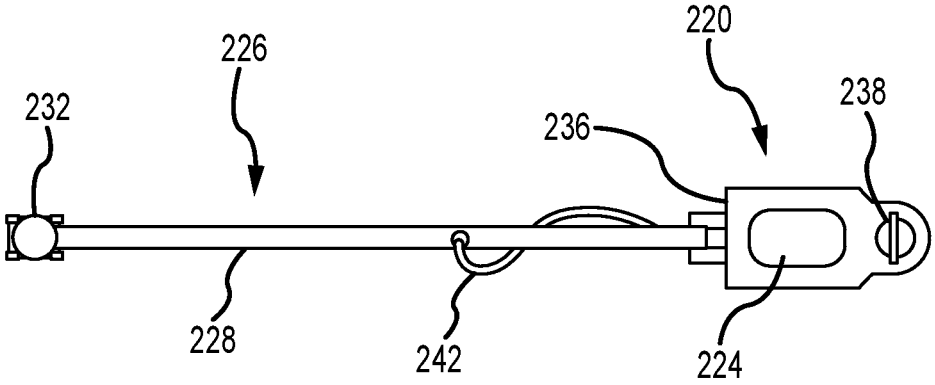
FIG. 13B is an end elevation view of the rotational drive of FIG. 13A.
Figure 13C:
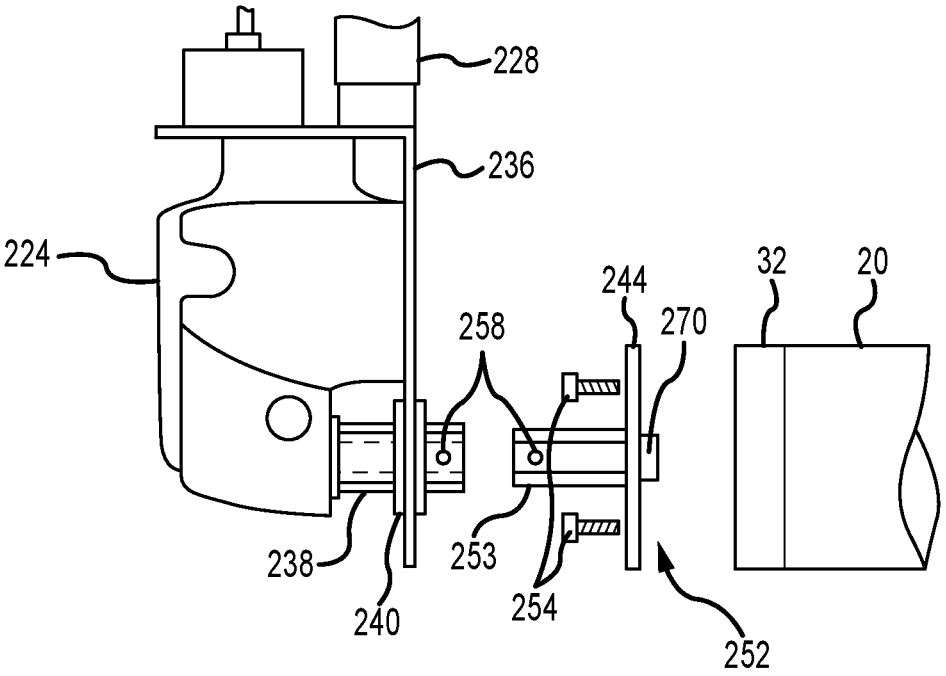
FIG. 13C is a front elevation, exploded view of drive motor and drive plate assembly components of the rotational drive of FIG. 13A, illustrating the manner by which they may engage a rotatable drive shaft or tube of a curb former.
Figure 13D:
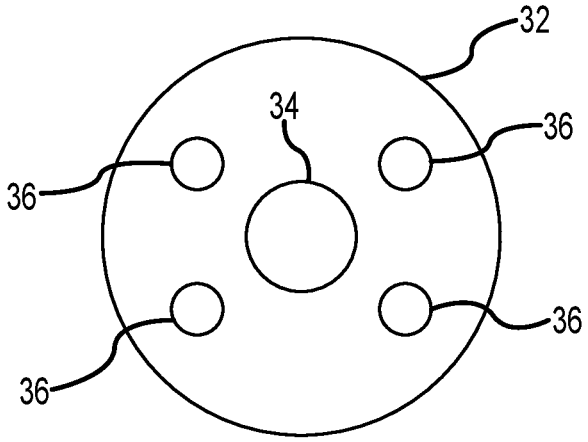
FIG. 13D is an end view an input end of the rotatable drive shaft or tube shown in FIG. 13C.

The output of the drive motor 224 is configured so that it can be fitted to a drive socket 238, which may be of a common 6-point impact type as illustrated in FIG. 13C. As the drive socket 238 passes through the motor frame 236, the drive socket 238 is encased by a socket bearing 240. The socket bearing 240 allows the drive socket 238 to rotate with the drive motor 224, while securely holding it within the stationary motor frame 236. The use of the drive socket 238 allows for the securement of a drive plate assembly 252, which in turn bolts to the proximal end of the drive shaft 20. To facilitate this, the drive plate assembly 252 is equipped with a rearwardly extending hexagonal shaft 253 that is specifically designed to engage the internal surface of the drive socket 238. Additionally, each of these components has an attachment pin hole 258. The attachment pin holes 258 allow for the passage of an attachment pin or the like (not shown) through the drive socket 238 and hexagonal shaft 253 to secure the two together (such that they collectively rotate).

The drive plate assembly 252 also has a circular drive plate 244 that may be of the same outside diameter as the drive shaft 20 of the curb former. The drive plate 244 allows for the attachment of the drive plate assembly 252 to the drive shaft 20 through the use of a plurality of bolts 254 or other suitable fasteners (e.g., that threadably engage with a corresponding threaded hole 36 of the plug 32 on the driven end of the drive shaft 20). Additionally, the distal surface of the drive plate 244 is equipped with a centrally located male shoulder 270 that operates to center a female attachment plug 32 of the drive shaft 20 with reference to the drive plate assembly 252 (e.g., shoulder 270 is disposed within recess 34 of the plug 32 on the driven end of the drive shaft 20). This configuration not only transfers the rotational power of the drive motor 224 to the drive shaft 20, but also ensures that all of the operational components are properly aligned.

Figure 14A:
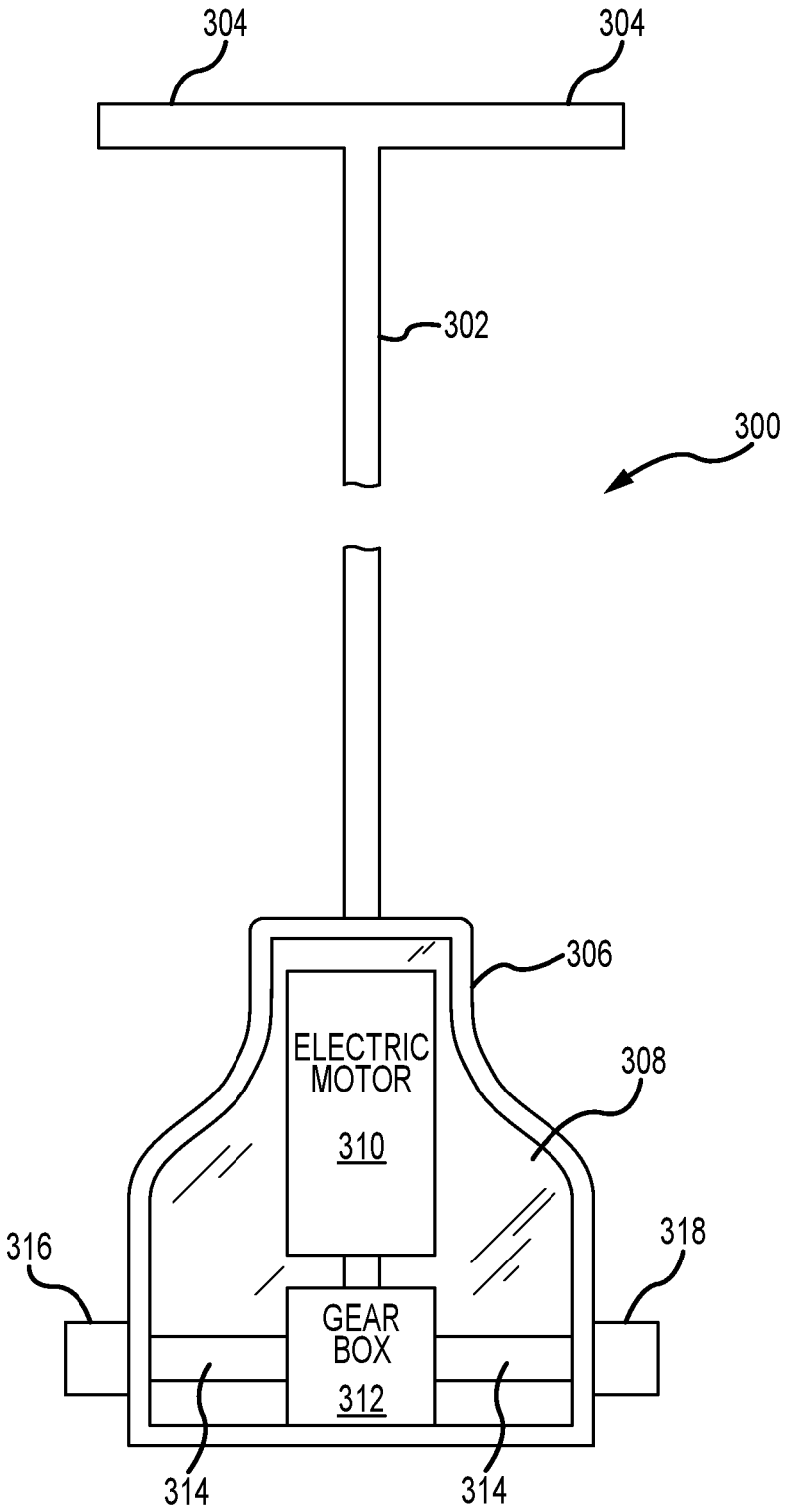
FIG. 14A is a front view of one embodiment of a dual-drive power unit for a curb former, where the power source is in the form of an electric motor.

FIG. 14A illustrates one embodiment of a dual-drive power unit 300 that may be used rotate the drive shaft 20 of a curb former of the type addressed herein. The dual-drive power unit 300 includes a handle 302 having a pair of grips 304 for engagement by an operator. The handle 302 may be attached to a frame 306 in any appropriate manner (e.g., detachably, fixedly). The handle 302, grips 304, and frame 306 each may be of any appropriate size, shape, and/or configuration, and may be formed from any appropriate material or combination of materials.

A power source in the form of an electric motor 310 is supported relative to the frame 306 in any appropriate manner. The electric motor 310 may be of any appropriate size for a curbing application. The output of the electric motor 310 provides/defines an input for a gearbox 312. An output of the gearbox 312 is in the form of a rotatable shaft 314. The gearbox 312 may be of any appropriate size, shape, configuration, and/or type. The gearbox 312 may also provide any appropriate gear reduction.

What may be characterized as a first drive output 316 is rotated by the output shaft 314 from the gearbox 312, and this first drive output 316 may be detachably interconnected with the drive shaft 20 of the curb former in any appropriate manner. A second drive output 318 is also rotated by the output shaft 314 from the gearbox 312, and this second drive output 318 may be detachably interconnected with the drive shaft 20 of the curb former in any appropriate manner. Each of the first drive output 316 and the second drive output 318 may be in the form of a drive socket or coupling for providing a desired interface with the drive shaft 20 of the curb former so as to be able to rotate the same.

The dual-drive power unit 300 may also include a back plate 308 and a front plate or shield (not shown). The back plate 308 may be attached to the frame 306 in any appropriate manner, and furthermore may be used to structurally support the electric motor 310. The back plate 308, along with the noted front plate (which may be attached to the frame 306 and/or back plate 308 in any appropriate manner, including detachably or fixedly), may at least partially enclose the electric motor 310 to offer at least some degree of protection for the same during handling/use of the power unit 300.

The first drive output 316 and the second drive output 318 rotate at a common speed and in a common direction. The first drive output 316 and the second drive output 318 may be characterized as being disposed in opposing relation or on opposite sides of the dual-drive power unit 300. Incorporating these oppositely disposed first drive output 316 and second drive output 318 allows the dual-drive power unit 300 to be attached to either end of the drive shaft 20 of a curb former and so as to be able to pull the curb former in each of first and second directions that are opposite of each other.

Figure 14B:
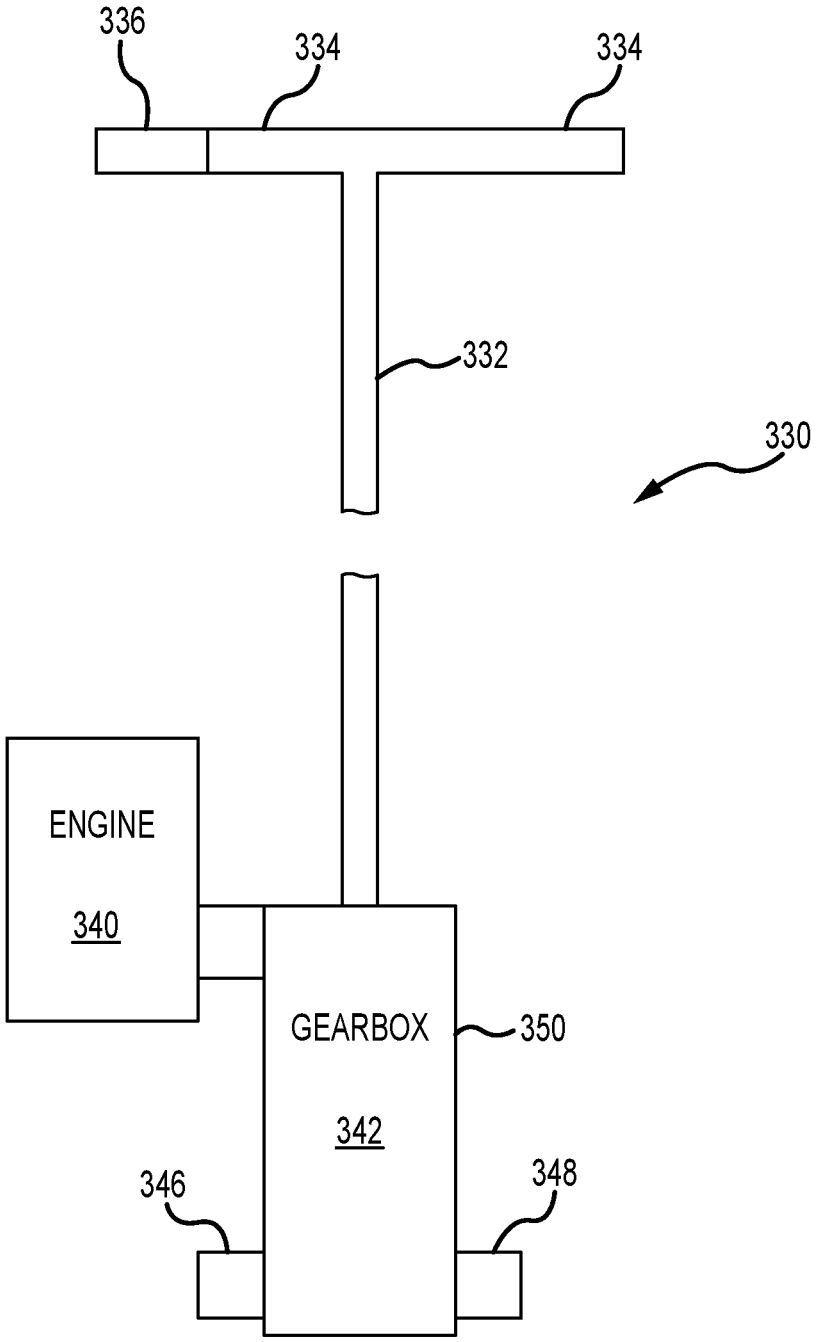
FIG. 14B is a front view of another embodiment of a dual-drive power unit for a curb former, where the power source is in the form of an engine.
Figure 15A:
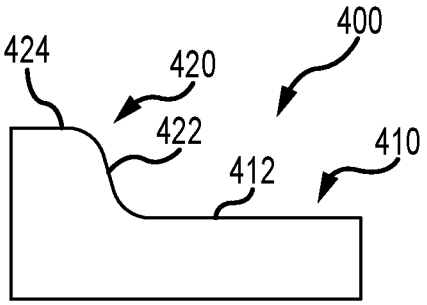
FIGS. 15A-H are representative integral curb and gutter configurations that may be defined by the curb former of FIGS. 1-3, the curb former of FIG. 6, the curb former of FIG. 12, and the rotary screed of FIG. 16, using an appropriately configured curb profiling drum.
Figure 15B:
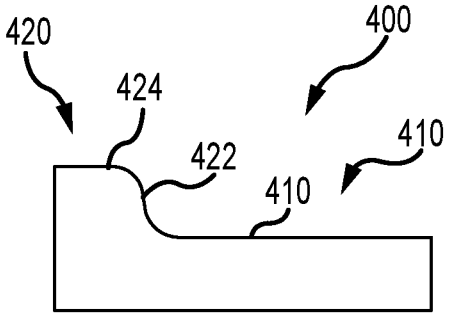
Figure 15C:
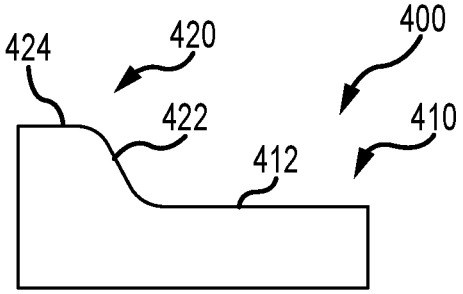
Figure 15D:
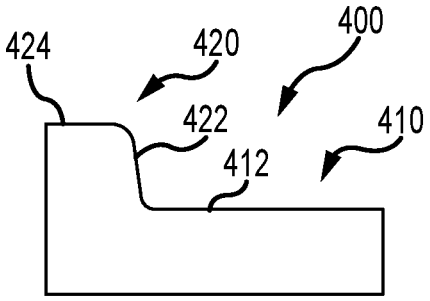
Figure 15E:
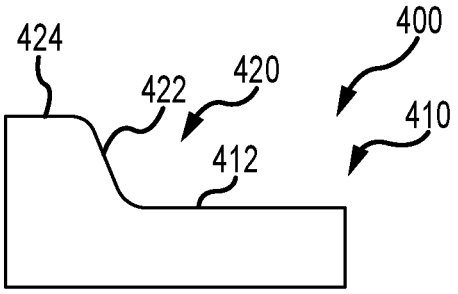
Figure 15F:
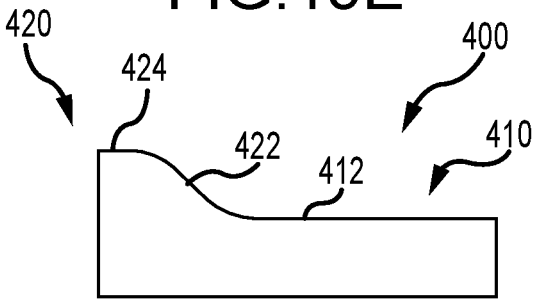
Figure 15G:
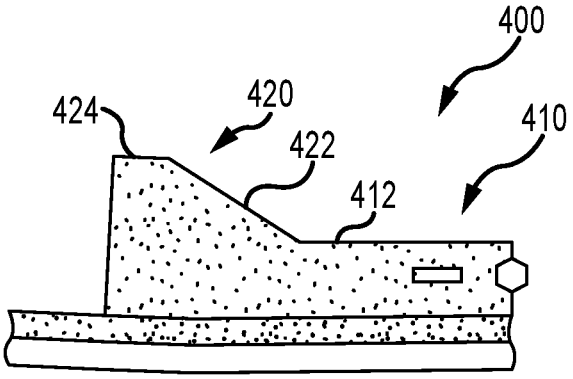
Figure 15H:
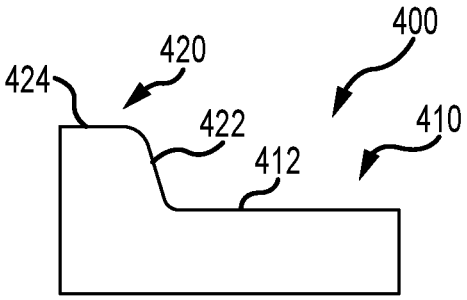

FIG. 14B illustrates another embodiment of a dual-drive power unit 330 that may be used rotate the drive shaft 20 of a curb former of the type addressed herein. The dual-drive power unit 330 includes a handle 332 having a pair of grips 334 for engagement by an operator. The handle 332 may be attached to a gearbox housing 350 in any appropriate manner (e.g., detachably, fixedly). A throttle 336 may be incorporated into one or both of the grips 334. The handle 332, grips 334, and gearbox housing 350 each may be of any appropriate size, shape, and/or configuration, and may be formed from any appropriate material or combination of materials.

A power source in the form of an engine 340 (e.g., gasoline; internal combustion) is supported from the gearbox housing 350 in any appropriate manner. The engine 340 may be of any appropriate size for a curbing application. The output of the engine 340 provides/defines an input for a gearbox 342 that is located within the gearbox housing 350. The gearbox 342 may be of any appropriate size, shape, configuration, and/or type (e.g., one or more gears, one or more sprocket/chain drives, or both; a planetary gear system). The gearbox 342 may also provide any appropriate gear reduction. In one embodiment, the engine 340 provides an output of about 6,000 RPM, while the output of the gearbox 342 is within a range of about 250 RPM to about 300 RPM (e.g., the gearbox 342 may provide a gear reduction within a range of about 24:1 to about 20:1 in this example).

What may be characterized as a first drive output 346 from the gearbox 342 may be detachably interconnected with the drive shaft 20 of a curb former in any appropriate manner. A second drive output 348 from the gearbox 342 may be detachably interconnected with the drive shaft 20 of a curb former in any appropriate manner. Each of the first drive output 346 and the second drive output 348 may be in the form of a drive socket or coupling for providing a desired interface with a screed roller so as to be able to rotate the same.

The first drive output 346 and the second drive output 348 rotate at a common speed and in a common direction. The first drive output 346 and the second drive output 348 may be characterized as being disposed in opposing relation or on opposite sides of the dual-drive power unit 330. Incorporating these oppositely disposed first drive output 346 and second drive output 348 allows the dual-drive power unit 330 to be attached to either end of the drive shaft 20 of a curb former and so as to be able to pull the curb former in each of first and second directions that are opposite of each other.

FIGS. 15A-H show various representative examples of an integral curb and gutter 400 that may be formed using any of the curb formers 10, 10', and 10". Each such integral curb and gutter 400 includes a gutter 410 and a curb 420 that are of an integral construction (e.g., no joint between the curb 420 and gutter 410). The gutter 410 has a base or base surface 412 that is primarily defined by the gutter profiling surface 86 of the gutter drum 80. The curb 420 has a riser or sidewall 422 and an upper wall 424. The sidewall 422 of the curb 420 is defined by at least a portion of the curb profiling surface 106 of a corresponding curb profiling drum 100, while the upper wall 424 of the curb 420 may be defined by a portion of the curb profiling surface 104 of a corresponding curb profiling drum 100, by an adjacent portion of the drive shaft 20, or both.

Each of the curb formers addressed herein may be used to define an integral curb and gutter. This may be done using a form assembly, such as of the type shown in FIGS. 11A and 11B. In this case the gutter drum 80 would typically be disposed on the upper surface 172 of the lower form 170. Either one or more of an end portion of a curb profiling drum 100 and/or an adjacent portion of the drive shaft 20, or the sleeve 140 of a guide 120 (if a guide 120 is being used), would be positioned on the upper surface 182 of the upper form 180. The curb formers addressed herein could also be used to define an integral curb and gutter, where one or both of the above-noted forms is replaced with a concrete slab or the like (e.g., an adjacent portion of a road, street, highway, or the like). In any case, the curb formers addressed herein are supported by a pair of surfaces between which an integral curb and gutter is to be formed (e.g., these curb formers may be disposed on two or more supports that are spaced from one another), and during/for a curbing operation.

Figure 16:
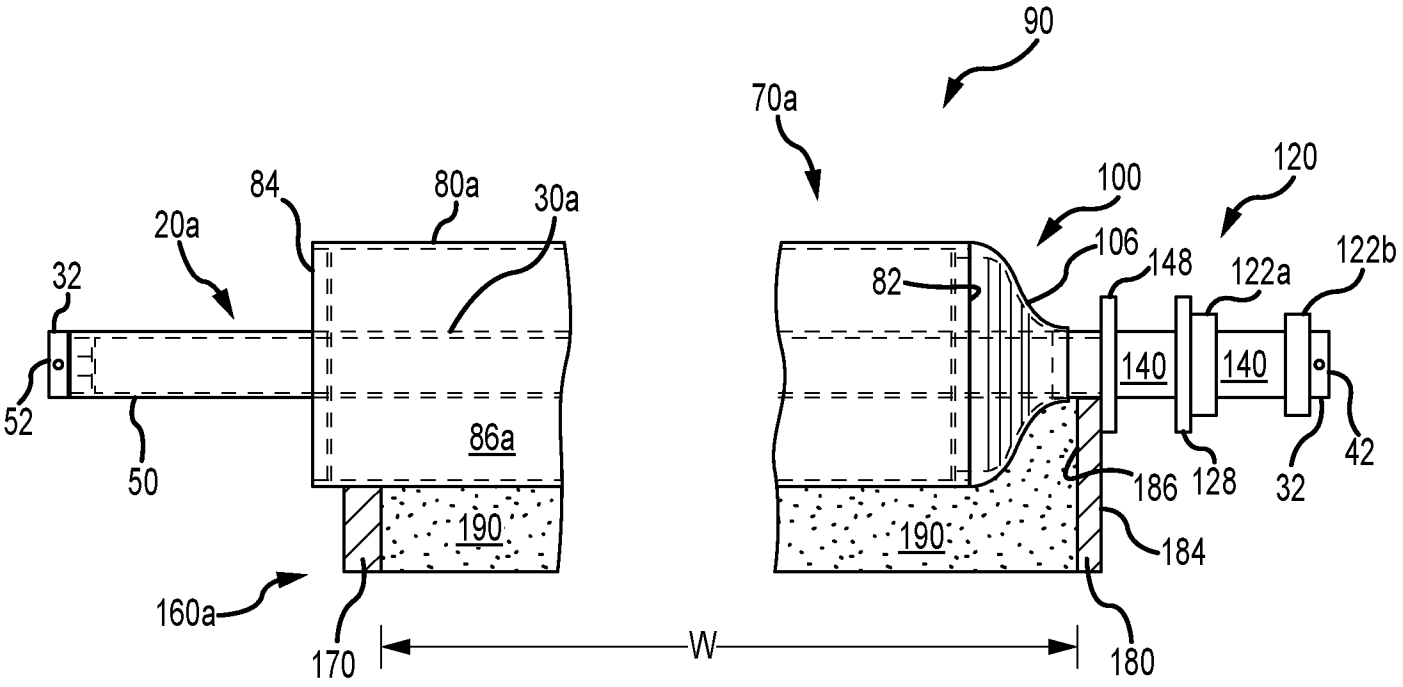
FIG. 16 is a side view of one embodiment of a cement screeding system or rotary screed that simultaneously forms a lane and an associated curb.

One embodiment of what may be referred to as a cement screeding system or a rotary screed is illustrated in FIG. 16 and is identified by reference numeral 90. The rotary screed 90 is similar to the curb formers addressed herein (and as such may also be referred to as a curb former), except that the rotary screed has been adapted to simultaneously form a concrete lane and curb (e.g., in a single pass of the rotary screed 90). Such a concrete lane may be in the form of a road, street, highway, cart path, walkway, or the like. Such a concrete lane for a road, street, or highway may be of a width to accommodate a single vehicle. The rotary screed 90 could be utilized to simultaneously form a single vehicle lane and curb, and thereafter may be utilized to simultaneously form an adjacent single vehicle lane and curb to define a two-lane roadway with a pair of spaced curbs. It may be that the rotary screed 90 could be configured/utilized to simultaneously form a lane and at least one integral curb, where the lane is of a width that accommodates multiple vehicles.

The rotary screed 90 uses at least some of the same components as one or more of the curb formers described herein. These components are identified by the same reference numerals in FIG. 16 and the discussion above regarding these components remains equally applicable to the rotary screed 90. Those corresponding components of the rotary screed 90 that differ in one or more respects are further identified by an "a" designation in FIG. 16.

Components of the rotary screed 90 include a drive shaft or tube 20*a* and a drum assembly 70*a* that are collectively rotatable in a common direction and at a common rotational speed (e.g., the drive shaft 20*a* and drum assembly 70*a* simultaneously rotate in a common direction and at a common rotational speed), and that are each longer than the corresponding components of the curb formers addressed above. The drive shaft 20*a* for the rotary screed 90 may be of any appropriate configuration for imparting a rotational force/rotational motion to the drum assembly 70*a*. As above, the illustrated embodiment has the drive shaft 20*a* being in the form of a rotatable screed roller of a type disclosed in U.S. Pat. No. 7,544,012, the entire disclosure of which is incorporated by reference.

The drum assembly 70*a* is configured to simultaneously form an integral lane and curb. In this regard, the drum assembly 70*a* includes a drum 80*a* (longer than the drum 80 for the curb formers addressed above) and a curb profiling drum 100 (again, which is detachable relative to both the drive shaft 20*a* and the drum 80*a* to allow the rotary screed 90 to produce different curb profiles). The drum 80*a* is that portion of the drum assembly 70*a* that forms/defines a concrete lane. In this regard, the drum 80*a* includes a drum body or lane profiling surface 86*a* (e.g., a perimeter surface of the drum 80*a*) that extends from the first drum end 82 to the second drum end 84 and that is disposed about the drive shaft 20*a* (e.g., the lane profiling surface 86*a* may be concentrically disposed relative to the drive shaft 20*a*, particularly its rotational axis). The drive shaft 20*a* and the drum 80*a* are fixed to one another in any appropriate manner (e.g. via one or more welds) such that the drum 80*a* will rotate along with the drive shaft 20*a* when being rotated by an appropriate rotational drive source. In the illustrated embodiment, the drum body 86*a* is cylindrical (more specifically its perimeter), with the drive shaft 20*a* extending through the center of this cylinder 86*a* (e.g., the drum body 86*a* and the tube body 30*a* are concentrically disposed in the illustrated embodiment).

The rotary screed 90 of FIG. 16 may be characterized as a "longer" version of the curb former 10' of FIG. 6 (with the increase in length being provided by a longer drum 80*a* and a longer drive shaft 20*a*). One embodiment has the drum assembly 70*a* being of a length of at least 5 feet. The drum 80*a* is that portion of the drum assembly 70*a* that is used to form a lane, and as such may be referred to as a "lane forming section" of the drum assembly 70*a*. The curb profiling drum 100 is that portion of the drum assembly 70*a* that is used to form a curb, and as such may be referred to as a "curb forming section" of the drum assembly 70*a*. Although the configuration of the rotary screed 90 of FIG. 16 is advantageous with regard to the ability to change a resulting curb profile by simply using a curb profiling drum 100 having a different curb profiling surface 106, the drum assembly 70*a* could instead be of an integral construction with a lane profiling surface 86*a* and a curb profiling surface 106. It also should be appreciated that the lane forming section of drum assembly 70 could be defined by a single drum 80*a* or a plurality of drums 80*a* that are disposed in end-to-end relation along the drive shaft 20*a*.

FIG. 16 shows the rotary screed 90 being used with a support assembly 160*a* to simultaneously define a lane and curb. The support assembly 160*a* in FIG. 16 primarily differs from the form assembly 160 of FIGS. 11A and 11B only in relation to the spacing "W" between its lower support 170 (the supports 178 not being shown in FIG. 16) and its upper support 180 (the supports 188 not being shown in FIG. 16). Typically the spacing W between the supports 170, 180 will be at least 5 feet so as to provide a lane of an acceptable width. Each of the lower support 170 and the upper support 180 may be of any appropriate configuration. For instance, the lower support 170 may be a form, a screed pole, or a screed pipe. The lower support 170 could also be in the form of an existing/previously-formed lane. What is of importance is that the rotary screed 90 is supported at a plurality of locations while simultaneously forming a lane and at least one curb.

As in the case of the curb formers addressed herein, the rotary screed 90 is pulled in a first direction in the longitudinal or length dimension to simultaneously form a lane and an integral curb using a support assembly 160*a*. Rotation of the drive shaft 20*a* and drum assembly 70*a* would instead tend to advance the rotary screed 90 in an opposite second direction in the longitudinal or length dimension along the support assembly 160*a*. This may also be described as advancing the rotary screed 90 against the rotational force of the drive shaft 20*a* and drum assembly 70*a*, and in any case simultaneously forms a lane and integral curb by a screeding action relative to the wet concrete 190.

An appropriate rotational drive/drive assembly (e.g., FIGS. 13A-14B) could be interconnected with the first free end 42 of the drive shaft 20*a* of the rotary screed 90 to simultaneously form a lane and curb using the form assembly 160*a*, and such that an operator would walk on the outboard side of the upper support 180. An appropriate rotational drive/drive assembly (e.g., FIGS. 13A-14B) could be interconnected with the second free end 52 of the drive shaft 20*a* of the rotary screed 90 to simultaneously form a lane and curb using the form assembly 160*a*, and such that an operator would walk on the outboard side of the lower support 170 (or actually on the lower support 170 if in the form of an existing lane). In both of these instance, a handle assembly could be interconnected with the opposite, non-driven end of the drive shaft 20*a*. Yet another option would be to interconnect an appropriate rotational drive/drive assembly (e.g., FIGS. 13A-14B) with the first free end 42 of the drive shaft 20*a* of the rotary screed 90 and such that an operator would walk on the outboard side of the upper support 180, and to interconnect another appropriate rotational drive/drive assembly (e.g., FIGS. 13A-14B) with the second free end 52 of the drive shaft 20*a* of the rotary screed 90 such that an operator would walk on the outboard side of the lower support 170 (or actually on the lower support 170 if in the form of an existing lane), where these two rotational drives/drive assemblies would rotate the drive shaft 20*a* in a common rotational direction and at a common rotational speed.

Figure 17:
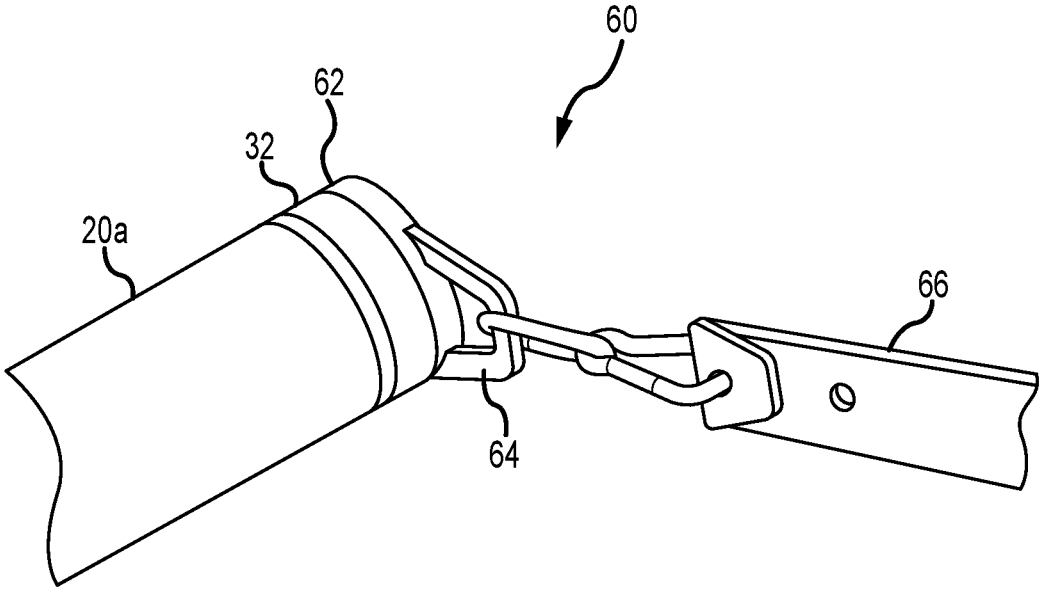
FIG. 17 is a perspective view of a handle assembly that may be used by the rotary screed of FIG. 16.

A representative embodiment of a handle assembly is shown in FIG. 17, is identified by reference numeral 60, and may be used when the rotary screed 90 is being driven by a single rotational drive/drive assembly. The handle assembly 60 of FIG. 17 includes a pull bearing 62 that is secured to the plug 32 on a non-driven end of the drive shaft 20*a* for the rotary screed 90 (the handle assembly 60 being spaced from the rotational drive/drive assembly along the drive shaft 20*a*). A handle bracket 64 extends from the outer housing of the pull bearing 62, with the drive shaft 20*a* thereby being rotatable relative to this handle bracket 64. A handle 66 engages the handle bracket 64 and extends away from the drive shaft 20*a* such that two operators could exert a pulling force on the rotary screed 90 (one handle being associated with the rotational drive/drive assembly, and the other being the handle assembly 60, and with each such handle being rotationally isolated from the drive shaft 20*a* so as to not rotate with the rotating drive shaft 20*a*). The handle 66 may be of any appropriate type/configuration and may be interconnected with the outer housing of the pull bearing 62 in any appropriate manner. Depending upon the length of the drum assembly 70*a* (or the spacing W between the lower support 170 and the upper support 180) and as noted above, it may be desirable for an appropriate rotational drive/drive assembly (e.g., FIGS. 14A-14B) to be interconnected with the first free end 42 of the drive shaft 20*a* of the rotary screed 90, and for an appropriate rotational drive/drive assembly (e.g., FIGS. 14A-14B) to be interconnected with the second free end 52 of the drive shaft 20*a* of the rotary screed 90.

The rotary screed 90 of FIG. 16 uses the guide 120 discussed above with regard to the curb formers. The rotary screed 90 could be used without this guide 120, or could be used with a different guide, to simultaneously form a lane and a curb (in one pass of the rotary screed 90). It should also be appreciated that one curb profiling surface could be incorporated on one end of the drum assembly 70*a* and that another curb profiling surface could be incorporated on the opposite end of the drum assembly 70*a* in order to simultaneously define a lane and a pair of laterally spaced curbs in a single pass of the rotary screed 90.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A curb former, comprising:

a drive shaft;

a drum mounted on said drive shaft and comprising first and second drum ends that are spaced from one another along said drive shaft, wherein a first drive shaft section extends beyond said first drum end in a direction that is away from said second drum end, and wherein a second drive shaft section extends beyond said second drum end in a direction that is away from said first drum end;

a first curb profiling drum positioned on said first drive shaft section and disposed in one of closely spaced or abutting relation to said first drum end;

a second curb profiling drum positioned on said second drive shaft section and disposed in one of closely spaced or abutting relation to said second drum end;

a guide positioned on and detachably mounted to said drive shaft separately from said first curb profiling drum, wherein said first curb profiling drum is located between said drum and said guide along said drive shaft, and wherein said guide rotates with said drive shaft;

wherein said guide is disposable at each of a plurality of different positions along said drive shaft to accommodate different spacings between said first curb profiling drum and said guide along said drive shaft and that produces a different width of an upper wall of a curb when formed by said first curb profiling drum, wherein said guide is detachably mountable to said drive shaft at each of said plurality of different positions.

2. The curb former of claim 1, wherein said drive shaft comprises a screed roller.

3. The curb former of claim 1, wherein said drum is fixedly attached to said drive shaft.

4. The curb former of claim 1, wherein said drum is a gutter drum.

5. The curb former of claim 1, wherein at least one of said first and second curb profiling drums is detachably mounted relative to each of said drive shaft and said drum.

6. The curb former of claim 1, wherein each of said first and second curb profiling drums is detachably mounted relative to each of said drive shaft and said drum.

7. The curb former of claim 1, further comprising a first plurality of fasteners that secure said first curb profiling drum to said drum and a second plurality of fasteners that secure said second curb profiling drum to said drum.

8. The curb former of claim 1, wherein said guide clamps onto said drive shaft.

9. The curb former of claim 1, wherein said guide comprises first and second split clamp rings that are spaced from one another along said drive shaft.

10. The curb former of claim 1, wherein said guide comprises a sleeve, a first guide flange that extends radially outwardly relative to said sleeve, and a second guide flange that is spaced from said first guide flange and that also extends radially outwardly relative to said sleeve, and wherein said first guide flange is located between said second guide flange and said first curb profiling drum.

11. A curbing system comprising:

the curb former of claim 10;

a lower form;

an upper form spaced from said lower form, that extends to a higher elevation than said lower form, and that comprises inboard and outboard surfaces with said inboard surface projecting in a direction of said lower form; and wet concrete between said lower form and said upper form;

wherein said drum is positioned on an upper surface of said lower form, one of said first curb profiling drum and said drive shaft is positioned on an upper surface of said upper form, and said first guide flange engages said outboard surface of said upper form.

12. A curbing system comprising:

the curb former of claim 10;

a lower form;

an upper form spaced from said lower form and that extends to a higher elevation than said lower form; and wet concrete between said lower form and said upper form;

wherein said drum is positioned on an upper surface of said lower form, said sleeve is positioned on an upper surface of said upper form, and an upper section of said upper form is positioned between said first and second guide flanges.

13. The curbing system of claim 11, wherein a maximum spacing between said lower form and said upper form is 36".

14. The curbing system of claim 11, wherein said drum defines a gutter and said first curb profiling drum defines a curb that is integral with said gutter.

15. The curb former of claim 1, wherein said first drive shaft section comprises a first drive input and wherein said second drive shaft section comprises a second drive input.

16. The curb former of claim 15, wherein said first drive input is on a first free end of said first drive shaft section and said second drive input is on a second free end of said second drive shaft section.

17. The curb former of claim 15, further comprising a drive assembly, a first drive configuration, and a second drive configuration, wherein said first drive configuration comprises said drive assembly interfacing with said first drive input of said first drive shaft section, and wherein said second drive configuration comprises said drive assembly interfacing with said second drive input of said second drive shaft section.

18. The curb former of claim 1, wherein said drum and said first curb profiling drum each comprise a perimeter surface that contacts wet concrete when forming a curb with said curb former, and wherein said perimeter surface of said drum and said perimeter surface of said first curb profiling drum are each concentrically disposed relative to a rotational axis of said drive shaft.

19. The curb former of claim 1, further comprising a second drive shaft and a second guide, said second guide positioned on and detachably mounted to said second drive shaft separately from said second curb profiling drum, wherein said second curb profiling drum is located between said drum and said second guide along said second drive shaft, and wherein said second guide rotates with said second drive shaft.

20. The curb former of claim 19, wherein said first curb profiling drum is used to define a first profile for a curb while said second curb profiling drum may be used to define a different second profile for said curb.

21. A rotary screed, comprising:

a drive shaft;

a drum assembly mounted on said drive shaft and comprising first and second drum ends that are spaced along said drive shaft by a distance of at least 5 feet, wherein said drum assembly comprises:

a first curb forming section comprising a first curb profiling surface; and a lane forming section comprising a lane profiling surface, wherein said lane forming section extends from said first curb forming section toward said second drum end, and wherein said lane profiling surface is cylindrical;

a guide positioned on and detachably mounted to said drive shaft separately from said first curb forming section, wherein said first curb forming section is located between said drum assembly and said guide along said drive shaft, and wherein said guide rotates with said drive shaft;

wherein said guide is disposable at each of a plurality of different positions along said drive shaft to accommodate different spacings between said first curb forming section and said guide along said drive shaft and that produces a different width of an upper wall of a curb when formed by said first curb forming section, wherein said guide is detachably mountable to said drive shaft at each of said plurality of different positions.

* * * * *